US007544455B2

(12) United States Patent
Yoshiba et al.

(10) Patent No.: US 7,544,455 B2
(45) Date of Patent: Jun. 9, 2009

(54) MAGNETIC TONER

(75) Inventors: Daisuke Yoshiba, Suntou-gun (JP); Katsuhisa Yamazaki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/179,090

(22) Filed: Jul. 24, 2008

(65) Prior Publication Data

US 2008/0286676 A1 Nov. 20, 2008

Related U.S. Application Data

(63) Continuation of application No. PCT/JP2008/050879, filed on Jan. 23, 2008.

(30) Foreign Application Priority Data

Jan. 26, 2007 (JP) ..... 2007-015976

(51) Int. Cl.
*G03G 9/083* (2006.01)

(52) U.S. Cl. ..... 430/106.2

(58) Field of Classification Search ..... 430/106.1, 430/106.2

See application file for complete search history.

(56) References Cited

U.S. PATENT DOCUMENTS

| | | | | |
|---|---|---|---|---|
| 4,495,268 | A | 1/1985 | Miyakawa | |
| 5,296,326 | A * | 3/1994 | Taya et al. | 430/106.2 |
| 6,803,164 | B2 * | 10/2004 | Mizoo et al. | 430/106.2 |

FOREIGN PATENT DOCUMENTS

JP 56-091241 7/1981

OTHER PUBLICATIONS

Patent Abstracts of Japan for JP 05-100474 and Japanese Patent Office machine-assisted translation of JP 05-100474 (pub. Apr. 23, 1993).*

Patent Abstracts of Japan for JP 06-100317 and Japanese Patent Office machine-assisted translation of JP 06-100317 (pub. Apr. 12, 1994).*

Patent Abstracts of Japan for JP 08-133744 and Japanese Patent Office machine-assisted translation of JP 08-133744 (pub. May 28, 1996).*

Patent Abstracts of Japan for JP 08-133745 and Japanese Patent Office machine-assisted translation of JP 08-133745 (pub. May 28, 1996).*

Patent Abstracts of Japan for JP 2001-002426 and Japanese Patent Office machine-assisted translation of JP 2001-002426 (pub. Jan. 9, 2001).*

Patent Abstracts of Japan for JP 2003-162089 and Japanese Patent Office machine-assisted translation of JP 2003-162089 (pub. Jun. 6, 2003).*

Patent Abstracts of Japan for JP 2003-195560 and Japanese Patent Office machine-assisted translation of JP 2003-195560 (pub. Jul. 9, 2003).*

Patent Abstracts of Japan for JP 2005-265958 and Japanese Patent Office machine-assisted translation of JP 2005-265958 (pub. Sep. 29, 2005).*

Patent Abstracts of Japan for JP 2006-133735 and Japanese Patent Office machine-assisted translation of JP 2006-133735 (pub. May 25, 2006).*

Patent Abstracts of Japan for JP 04-268570 and English-language translation of JP 04-268570 (pub. Sep. 24, 1992).*

Patent Abstracts of Japan for JP 04-141664 and English-language translation of JP 04-141664 (pub. May 15, 1992).*

Patent Abstracts of Japan for JP 04-162050, Jun. 5, 1992.

Patent Abstracts of Japan for JP 04-338971, Nov. 26, 1992.

Patent Abstracts of Japan for JP 62-143063, Jun. 26, 1987.

Patent Abstracts of Japan for JP 63-178256, Jul. 22, 1988.

* cited by examiner

*Primary Examiner*—Janis L Dote

(74) *Attorney, Agent, or Firm*—Fitzpatrick, Cella, Harper & Scinto

(57) ABSTRACT

A magnetic toner having magnetic toner particles each containing at least a binder resin and a magnetic iron oxide particle, in which: when a solution is prepared by dissolving the magnetic iron oxide particles in an acidic aqueous solution and an Fe element amount in a solution in which all the magnetic iron oxide particles are dissolved is defined as a total Fe element amount, a ratio X of the amount of Fe(2+) in a solution in which the magnetic iron oxide particles are dissolved to a state where 10 mass % of the total Fe element amount is present in the solution (solution having an Fe element-dissolving ratio of 10 mass %) to an Fe element amount in the solution having a specific Fe element-dissolving ratio; and the dielectric loss tangents of the magnetic toner measured at a temperature of 40° C. satisfy specific conditions.

7 Claims, No Drawings

MAGNETIC TONER

FIELD OF THE INVENTION

The present invention relates to a magnetic toner to be used in an image-forming method or toner jet method for visualizing an electrostatic image in electrophotography.

BACKGROUND OF THE INVENTION

In association with the widespread use of image-forming apparatuses such as a copying machine for electrophotography and a printer, the apparatuses have been finding use in an expanded variety of applications, and quality requested of an image formed by each of the apparatuses has become more and more severe in recent years. For example, each of the apparatuses has started to be used as not only a copying machine for paperwork for copying an original manuscript but also a digital printer as an output for a computer, an apparatus for copying a high-definition image such as a graphic design, or an apparatus for a light printing application where additionally high reliability is requested. Color tone reproducibility at not only a solid portion but also a halftone site is strongly requested in such application where high-definition image quality is strongly requested.

When an image is formed with magnetic toner using magnetic iron oxide particles each having a deteriorated degree of blackness in a system using magnetic toner, the color tone reproducibility of the image may involve, for example, the following problem: a black portion becomes reddish, so a desired tinge cannot be reproduced, and those who view the image feel abnormal. In addition, the use of magnetic iron oxide particles different from each other in degree of blackness causes a reduction in quality of an image formed with the particles due to image density unevenness.

An additional improvement of the system using the magnetic toner for copying a high-definition image or for a light printing application has been requested because those problems become remarkable particularly at a halftone site with a small toner laid-on level.

In addition, at the same time, the system has been strongly requested to provide images each having high sharpness stably over a long time period. Accordingly, wide-latitude images each of which: has good developing ability; and is free of fogging must be stably formed, and performance requested of the magnetic toner has become more and more sophisticated.

The quality of an image to be formed by a magnetic one-component developing method largely depends on the performance of magnetic toner to be used. Fine powdered magnetic iron oxide particles, which are mixed and dispersed in the magnetic toner particles of the magnetic toner in a considerable amount, each act as a pigment, and, at the same time, each affect the charging characteristic of the magnetic toner. That is, the degree of blackness of the magnetic toner is determined by the degree of blackness of each of the magnetic iron oxide particles, and each of the magnetic iron oxide particles acts as a leak point, so the electrical characteristics and dispersing ability of the magnetic iron oxide particles affect the electrical characteristics of the magnetic toner. As a result, the magnetic iron oxide particles affect the developing characteristic and durability of the magnetic toner. Accordingly, a large number of proposals have been conventionally made on magnetic iron oxide particles to be incorporated into magnetic toner particles.

The degree of blackness of a magnetic iron oxide particle, in particular, a magnetic iron oxide particle containing Fe(2+) such as a magnetite particle depends on the state of presence of Fe(2+). However, Fe(2+) in the magnetic iron oxide particle is apt to be oxidized, so the oxidation advances as time elapses after the production of the particle, and hence the content of Fe(2+) reduces. As a result, the degree of blackness of the particle reduces, the particle becomes strongly reddish, and the charging characteristic of the particle changes.

It should be noted that the expression "Fe(2+) of a magnetic iron oxide particle" as used in the present invention refers to a divalent iron atom, and comprehends an iron atom present as FeO or $Fe^{2+}$. In addition, the expression "Fe(3+)" refers to a trivalent iron atom.

Patent Documents 1 to 3 each disclose a technique involving increasing the amount of Fe(2+) of a black component with respect to the entirety of magnetic iron oxide particles in order that magnetic iron oxide particles each of which: has a high degree of blackness; and is excellent in environmental resistance may be obtained. Such magnetic iron oxide particles, if used, each show a somewhat high degree of blackness immediately after the production of the particles. However, the particles are each vulnerable to deterioration over time and poor in stability because each of the magnetic iron oxide particles is subjected to a reduction treatment, has a fine structure on its surface, or is oxygen-deficient. Accordingly, the particles are not preferable in an application where a document is stored for a long time period such as light printing because the degree of blackness of each of the particles is apt to deteriorate.

A technique involving adding various elements to magnetic iron oxide particles has also been disclosed. Patent Documents 4 and 5 each describe a magnetic iron oxide particle having a composite iron oxide coat layer containing Co, and Patent Document 6 describes a magnetic iron oxide particle having a composite iron oxide coat layer containing Zn. In addition, Patent Document 7 describes a magnetic iron oxide particle containing composite iron oxide containing an element such as Mn, Zn, Cu, Ni, Co, or Mg, Patent Document 8 describes a magnetic iron oxide particle having an Si-containing coat layer, and Patent Document 9 describes a Ti-containing magnetic iron oxide particle.

Each of those added elements plays the following role in suppressing the deterioration of the degree of blackness of each of the magnetic iron oxide particles: a particle is coated with an added element in order that Fe(2+) may be out of direct contact with an external atmosphere, or Fe(2+) is substituted by an added element the degree of blackness of which does not reduce.

The degree of blackness of each of magnetic iron oxide particles obtained by such method is prevented from reducing to a certain extent, and the deterioration of each of the particles over time is suppressed to a certain extent. However, a degree of blackness is apt to vary from magnetic iron oxide particle to magnetic iron oxide particle, and an image formed with the particles is apt to show density unevenness. In addition, a degree of blackness at a halftone site of the image must be additionally improved.

A method of improving the developing ability of magnetic toner by controlling the dispersing ability of magnetic iron oxide particles in the magnetic toner particles of the toner has also been proposed. The following proposal has also been made: the dispersing ability of a magnetic iron oxide particle is controlled by specifying the dielectric loss tangent of magnetic toner.

A disclosed in Patent Document 10 is as described below. The dielectric characteristics of magnetic toner are controlled by using magnetic iron oxide particles each having the following features: each of the magnetic iron oxide particles contains silicon in itself, and the surface of each of the magnetic iron oxide particles is coated with iron oxide composite containing silicon and zinc. However, the technique is susceptible to improvement in order that an image having an improved degree of blackness at a halftone site, good developing ability, and suppressed fogging may be obtained.

Patent Document 1: JP 2992907 B
Patent Document 2: JP 3239220 B
Patent Document 3: JP 2001-002426 A
Patent Document 4: JP 6-100317 A
Patent Document 5: JP 8-133744 A
Patent Document 6: JP 8-133745 A
Patent Document 7: JP 4-162050 A
Patent Document 8: JP 2006-133735 A
Patent Document 9: JP 2003-162089 A
Patent Document 10: JP 2003-195560 A

SUMMARY OF THE INVENTION

Problems to be solved by the Invention

An object of the present invention is to provide a magnetic toner that has dissolved the above-mentioned problems.

That is, the object of the present invention is to provide a magnetic toner with which images each having good developing ability, suppressed fogging, a high degree of blackness even at a halftone site, and suppressed density unevenness can be stably formed.

Means for Solving the Problems

The present invention for solving the above-mentioned problems relates to a magnetic toner having magnetic toner particles each containing at least a binder resin and a magnetic iron oxide particle, characterized in that: when a solution is prepared by dissolving the magnetic iron oxide particles in an acidic aqueous solution and an Fe element amount in a solution in which all the magnetic iron oxide particles are dissolved is defined as a total Fe element amount, a ratio X of an amount of Fe(2+) in a solution in which the magnetic iron oxide particles are dissolved to a state where 10 masse of the total Fe element amount is present in the solution (solution having an Fe element-dissolving ratio of 10 mass %) to an Fe element amount in the solution having an Fe element-dissolving ratio of 10 mass % is 34 mass % or more and 50 mass % or less; and dielectric loss tangents of the magnetic toner measured at a temperature of 40° C. satisfy the following conditions (a) to (c):

(a) a dielectric loss tangent A at a frequency of 10,000 Hz is $1.0\times10^{-6}$ or more and $1.0\times10^{-1}$ or less;

(b) a dielectric loss tangent B at a frequency of 1,000 Hz is $1.0\times10^{-6}$ or more and $1.0\times10^{-1}$ or less; and (c) a ratio (A/B) of the dielectric loss tangent A to the dielectric loss tangent B is 0.10 or more and 10.00 or less.

BEST MODE FOR CARRYING OUT THE INVENTION

The inventors of the present invention have conducted investigation on a component to be used in magnetic toner. As a result, the inventors have found that a magnetic toner that has dissolved the above-mentioned problems can be obtained by controlling a ratio of Fe(2+) in the vicinity of the surface of a magnetic iron oxide particle and the dielectric characteristics of the magnetic toner.

In the present invention, investigation has been conducted on the amount of Fe(2+) of magnetic iron oxide particles and the dielectric characteristics of the magnetic iron oxide particles with a view to satisfying an improvement in developing ability, the alleviation of fogging, an improvement in degree of blackness at a halftone site, and the alleviation of density unevenness.

An increase in content of Fe(2+) of the magnetic iron oxide particles is effective in improving the degree of blackness. However, it is difficult to increase the amount of Fe(2+) of the entirety of the magnetic iron oxide particles to an extent comparable to or higher than a certain extent, so it has been conventionally unable to obtain such magnetic iron oxide particles as specified in the present invention. In addition, the following procedure is a key to obtaining good-appearance images each of which has good developing ability and is free of fogging stably over a long time period: the triboelectric chargeability of magnetic toner is uniformized and stabilized to the extent possible. A relationship between the dielectric characteristics of the magnetic toner and the amount of Fe(2+) of magnetic iron oxide particles present in the magnetic toner particles of the toner must be optimized in order that the uniformization and the stabilization may be achieved.

In view of the foregoing, the inventors of the present invention have made extensive studies while paying attention to a relationship between the distributed state of Fe(2+) in the vicinity of the surface of a magnetic iron oxide particle and the dielectric characteristics of magnetic toner.

As a result, the inventors have found the following: a degree of blackness can be effectively improved by selectively increasing the amount of Fe(2+) in the vicinity of the surface of a magnetic iron oxide particle that contributes to a tinge to a large extent, whereby an image in which a degree of blackness is good even at a halftone site and density unevenness is dissolved can be obtained.

That is, magnetic iron oxide particles according to the present invention are characterized in that, when a solution is prepared by dissolving the magnetic iron oxide particles in an acidic aqueous solution and an Fe element amount in a solution in which all the magnetic iron oxide particles are dissolved is defined as a total Fe element amount, a ratio X of the amount of Fe(2+) in a solution in which the magnetic iron oxide particles are dissolved to a state where 10 mass % of the total Fe element amount is present in the solution (solution having an Fe element-dissolving ratio of 10 mass %) to an Fe element amount in the solution having an Fe element-dissolving ratio of 10 mass % is 34 mass % or more and 50 mass % or less, or preferably 35 mass % or more and 44 mass % or less. The Fe element-dissolving ratio in the above solution having an Fe element-dissolving ratio of 10 mass % is an indication showing information about the position of a magnetic iron oxide particle. That is, a solution having an Fe element-dissolving ratio of 0 mass % is a solution in which none of the magnetic iron oxide particles is dissolved, and a solution having an Fe element-dissolving ratio of 100 mass % is a solution in which the magnetic iron oxide particles are completely dissolved. That is, information about the position of a magnetic iron oxide particle meant by the solution having an Fe element-dissolving ratio of 100 mass % corresponds to the center of the magnetic iron oxide particle. In other words, an Fe element amount in the solution having an Fe element-dissolving ratio of 10 mass % (solution in which the magnetic iron oxide particles are dissolved to a state where 10 mass % of the above total Fe element amount is present in the solution) means an Fe element amount present as far as 10 mass % from the surfaces of the magnetic iron oxide particles. In addition, the above ratio X is a ratio of the amount of Fe(2+) to the Fe element amount present as far as 10 mass % from the surfaces of the magnetic iron oxide particles.

When the ratio X falls within the above range, a degree of blackness at a halftone portion of an image formed with magnetic toner containing the magnetic iron oxide particles can be favorably maintained, and the occurrence of density unevenness in the image can be suppressed. In addition, each of the magnetic iron oxide particles is lowly susceptible to oxidation, and can obtain good stability. Further, the triboelectric chargeability of the toner can favorably keep its balance, and a reduction in image density at the time of duration can be suppressed.

When a value (C/D) obtained by dividing a value C obtained by subtracting the amount of Fe(2+) in the above solution having an Fe element-dissolving ratio of 10 mass % from the amount of Fe(2+) in the above solution in which all the magnetic iron oxide particles are dissolved by a value D obtained by subtracting the Fe element amount in the above solution having an Fe element-dissolving ratio of 10 mass % from the above total Fe element amount is represented by Y, the magnetic iron oxide particles have a ratio (X/Y) of X to Y of preferably more than 1.00 and 1.30 or less, or more preferably more than 1.00 and 1.20 or less.

The ratio (X/Y) represents an Fe(2+) abundance ratio of the surfaces of the magnetic iron oxide particles to the insides of the particles. When the ratio X/Y falls within the above range, the amount of Fe(2+) in the particles is moderate, so the toner can be subjected to triboelectric charging in an additionally favorable manner, and the occurrence of fogging or density unevenness in an image formed with the toner can be favorably suppressed.

In addition, the inventors have found that the triboelectric chargeability of magnetic toner can be uniformized and stabilized by adjusting the dielectric characteristics of the magnetic toner so that the characteristics satisfy specific conditions in a state where such magnetic iron oxide particles are used.

Dielectric loss tangents of the magnetic toner of the present invention measured at a temperature of 40° C. satisfy the following conditions (a) to (c):

(a) a dielectric loss tangent A at a frequency of 10,000 Hz is $1.0\times10^{-6}$ or more and $1.0\times10^{-1}$ or less;

(b) a dielectric loss tangent B at a frequency of 1,000 Hz is $1.0\times10^{-6}$ or more and $1.0\times10^{-1}$ or less; and (c) a ratio (A/B) of the dielectric loss tangent A to the dielectric loss tangent B is 0.10 or more and 10.00 or less.

It should be noted that the dielectric loss tangent A at a frequency of 10,000 Hz is preferably $1.0\times10^{-5}$ or more and $1.0\times10^{-2}$ or less, the dielectric loss tangent B at a frequency of 1,000 Hz is preferably $1.0\times10^{-5}$ or more and $1.0\times10^{-2}$ or less, and the ratio A/B is preferably 0.30 or more and 7.00 or less.

A state where the dielectric loss tangents satisfy the above conditions (a) and (b) means that the magnetic iron oxide particles are dispersed in the magnetic toner particles of the magnetic toner in a nearly uniform state. In addition, a state where the dielectric loss tangents satisfy the condition (c) means that the dielectric loss tangent of the magnetic toner depends on a frequency to a small extent.

It should be noted that the dielectric loss tangent A, the dielectric loss tangent B, and the ratio (A/B) described above can each be adjusted to fall within the above range by changing the kinds or composition (especially a ratio of a high-softening-point resin (H) to a low-softening-point resin (L) to be described later) of binder resins to be used.

The uniform dispersion of the magnetic iron oxide particles in the magnetic toner particles can: improve the developing ability of the magnetic toner; and favorably suppress fogging in an image formed with the toner. In addition, the fact that the dielectric loss tangent of the magnetic toner depends on a frequency to a small extent provides the following merit. That is, in a magnetic jumping developing method, an AC bias is applied to a developing sleeve at the time of development, and the frequency of the bias is generally of the order of several kilohertz, which is at the same level as that of the frequency at which the dielectric loss tangent of the magnetic toner of the present invention is measured. In other words, the fact that the dielectric loss tangent of the magnetic toner depends on a frequency to a small extent means that the magnetic toner has a stable developing characteristic irrespective of conditions for development.

In addition, when the dielectric loss tangents A and B each fall within the above range, the magnetic toner easily obtains good triboelectric chargeability, and can suppress the occurrence of fogging or a reduction in image density at the time of duration.

The inventors of the present invention have found that the triboelectric chargeability of the magnetic toner can be additionally uniformized, and can be stabilized over a long time period by using magnetic iron oxide particles with an increased Fe(2+) amount in the vicinities of their surfaces, and, furthermore, providing the magnetic toner with specific dielectric characteristics. As a result, it has become possible to obtain good-appearance images each having good developing ability and suppressed fogging stably over a long time period.

Although the reason why the above effect can be obtained by using magnetic iron oxide particles with an increased Fe(2+) amount in the vicinities of their surfaces in magnetic toner having specific dielectric characteristics has not been theoretically clarified, the reason is assumed to be as described below.

The use of magnetic iron oxide particles having an Fe(2+) amount in the vicinities of their surfaces within a range specified in the present invention in magnetic toner causes efficient charge exchange between Fe(2+) and Fe(3+) in the vicinity of the surface of each of the magnetic iron oxide particles. As a result, charge transfer in each of the magnetic iron oxide particles becomes smooth, so the triboelectric chargeability of the magnetic toner may be additionally uniformized and stabilized. In addition, the toner can stably provide good-appearance images each having good developing ability and suppressed fogging over a long time period. Those effects are synergistically exerted particularly in a magnetic toner in which a magnetic substance is uniformly dispersed in each magnetic toner particle and the dielectric characteristics of which depend on a frequency to a small extent.

It is preferable that a specific kind of a metal element be incorporated into the core particle of each of the magnetic iron oxide particles and a coat layer containing a specific kind of a metal element be formed on the surface of the core particle in order that the ratio X of Fe(2+) may be stably controlled within the range of the present invention.

In addition, it is more preferable that silicon or zinc be incorporated into the core particle of each of the magnetic iron oxide particles and a coat layer containing silicon, aluminum, or zinc be formed on the surface of each of the magnetic iron oxide particles in terms of compatibility between the triboelectric chargeability and heat resistance of the toner. For example, it is particularly preferable that silicon be incorporated into each core particle and a coat layer containing silicon and aluminum be formed on the surface of the core particle.

In addition, the amount of silicon in the core particles of the magnetic iron oxide particles is preferably 0.20 mass % or more and 1.50 mass % or less, or more preferably 0.25 mass % or more and 1.00 mass % or less in terms of a silicon element with respect to the entirety of the magnetic iron oxide particles.

In addition, the amount of silicon in the coat layers is preferably 0.05 mass % or more and 0.50 mass % or less, or more preferably 0.10 mass % or more and 0.25 mass % or less in terms of a silicon element with respect to the entirety of the magnetic iron oxide particles.

Further, the amount of aluminum in the coat layers is preferably 0.05 mass % or more and 0.50 mass % or less, or more preferably 0.10 mass % or more and 0.25 mass % or less in terms of Al with respect to the entirety of the magnetic iron oxide particles.

In addition, the magnetic iron oxide particles each more preferably have an octahedral shape in terms of the dispersing ability of the magnetic iron oxide particles in the magnetic toner particles and the black tinge of each of the magnetic iron oxide particles.

In addition, the magnetic iron oxide particles have a number average primary particle diameter of preferably 0.10 μm or more and 0.30 μm or less, or more preferably 0.10 μm or more and 0.20 μm or less.

Controlling the number average primary particle diameter of the magnetic iron oxide particles within the above range improves the ease with which the magnetic iron oxide particles are uniformly dispersed in the magnetic toner particles. As a result, good-appearance images in each of which a degree of blackness at a halftone site can be improved effectively, density unevenness can be dissolved effectively, and, furthermore, fogging is suppressed effectively can be obtained in an additionally stable manner over a long time period. In addition, charge transfer through each of the magnetic iron oxide particles is favorably performed. Further, the oxidation of Fe(2+) can be suppressed; each of the magnetic iron oxide particles can obtain a good black tinge from the viewpoint as well.

In addition, the magnetic iron oxide particles have a magnetization in an external magnetic field of 795.8 kA/m of preferably 86.0 $Am^2/kg$ or more, or more preferably 87.0 $Am^2/kg$ or more.

On the other hand, the magnetic iron oxide particles have a magnetization in an external magnetic field of 795.8 kA/m of preferably 91.0 $Am^2/kg$ or less, or more preferably 90.0 $Am^2/kg$ or less.

It should be noted that the above magnetization can be increased by increasing the amount of Fe(2+), and can be adjusted to fall within the above range by adjusting the amount of a metal element such as silicon or zinc to be incorporated into the magnetic iron oxide particles.

When the above magnetization falls within the above range, the formation of a magnetic brush on a developing sleeve becomes particularly good, the toner can obtain good developing ability, and the occurrence of fogging in an image formed with the toner can be favorably suppressed.

In addition, the magnetic iron oxide particles are used in an amount of preferably 20 parts by mass or more and 150 parts by mass or less, or more preferably 50 parts by mass or more and 120 parts by mass or less with respect to 100 parts by mass of a binder resin. When the magnetic iron oxide particles are used in an amount within the above range, compatibility between a good degree of blackness and developing ability can be achieved in an additionally favorable manner.

A general method of producing magnetite particles may be employed as a method of producing the magnetic iron oxide particles to be used in the present invention without any particular problem; a particularly preferable method of producing the magnetic iron oxide particles will be specifically described below.

The magnetic iron oxide particles to be used in the present invention can be produced by, for example, oxidizing ferrous hydroxide slurry prepared by causing an aqueous solution of a ferrous salt and an alkaline solution to neutralize and mix with each other.

Any ferrous salt can be used as the ferrous salt as long as the salt is water-soluble, and examples of the salt include ferrous sulfate and ferrous chloride. In addition, a water-soluble silicate (such as sodium silicate) is preferably added to and mixed with the ferrous salt at a content of 0.20 mass % or more and 1.50 mass % or less in terms of a silicon element with respect to the final total amount of the magnetic iron oxide particles.

Next, an aqueous solution of the resultant silicon component-containing ferrous salt and the alkaline solution are caused to neutralize and mix with each other. Thus, the ferrous hydroxide slurry is produced.

Here, an aqueous solution of an alkali hydroxide such as an aqueous solution of sodium hydroxide or an aqueous solution of potassium hydroxide can be used as the alkaline solution.

The amount of the alkaline solution upon production of the ferrous hydroxide slurry has only to be adjusted depending on the required shape of each of the magnetic iron oxide particles. To be specific, spherical particles are obtained when the pH of the ferrous hydroxide slurry is adjusted to less than 8.0. In addition, hexahedral particles are obtained when the pH is adjusted to 8.0 or more and 9.5 or less, and octahedral particles are obtained when the pH is adjusted to exceed 9.5. Accordingly, the pH should be appropriately adjusted.

In order that iron oxide particles may be obtained from the ferrous hydroxide slurry thus prepared, an oxidation reaction is performed while an oxidative gas, or preferably air, is blown into the slurry. During the blowing of the oxidative gas, the temperature of the slurry is kept at preferably 60 to 100° C., or particularly preferably 80 to 95° C. by heating the slurry.

The above ratio X in the magnetic iron oxide particles is controlled within the range of the present invention by, for example, controlling the oxidation reaction. To be specific, the following procedure is preferably adopted: the amount in which the oxidative gas is blown is gradually reduced in association with the progress of the oxidation of ferrous hydroxide so that the amount in which the gas is blown at the final stage is small. The amount of Fe(2+) on the surfaces of the iron oxide particles can be selectively increased by performing a multistage oxidation reaction as described above. When air is used as the oxidative gas, the amount in which air is blown is preferably controlled, for example, as described below for slurry containing 100 moles of an iron element. It should be noted that the amount in which air is blown is gradually reduced within the following range.

Until 50% of the molecules of ferrous hydroxide are turned into iron oxide molecules: 10 to 80 liters/min, or preferably 10 to 50 liters/min Until more than 50% and 75% or less of the molecules of ferrous hydroxide are turned into iron oxide molecules:

5 to 50 liters/min, or preferably 5 to 30 liters/min

Until more than 75% and 90% or less of the molecules of ferrous hydroxide are turned into iron oxide molecules:

1 to 30 liters/min, or preferably 2 to 20 liters/min

Stage at which more than 90% of the molecules of ferrous hydroxide are turned into iron oxide molecules: 1 to 15 liters/min, or particularly 2 to 8 liters/min Next, an aqueous solution of sodium silicate and an aqueous solution of aluminum sulfate are simultaneously charged into the resultant slurry of the iron oxide particles, and the pH of the mixture is adjusted to 5 or more and 9 or less so that a coat layer containing silicon and aluminum is formed on the surface of each of the particles.

The resultant slurry of magnetic iron oxide particles each having a coat layer is filtrated, washed, dried, and pulverized by ordinary methods, whereby the magnetic iron oxide particles are obtained.

In addition, the magnetic iron oxide particles are preferably loosened once by applying shear to the slurry at the time of production for the purpose of improving the fine dispersing ability of the magnetic iron oxide particles in the magnetic toner particles.

Next, the binder resin to be used in the magnetic toner of the present invention will be described. For example, any one of the following resins can be used as the binder resin: a styrene resin, a styrene copolymer resin, a polyester resin, a polyol resin, a polyvinyl chloride resin, a phenol resin, a natural modified phenol resin, a natural resin modified maleic resin, an acrylic resin, a methacrylic resin, polyvinyl acetate, a silicone resin, a polyurethane resin, a polyamide resin, a furan resin, an epoxy resin, a xylene resin, polyvinyl butyral, a terpene resin, a coumarone-indene resin, and a petroleum resin. Of those, a styrene copolymer resin, a polyester resin, a mixture of a polyester resin and a styrene copolymer resin, or a hybrid resin obtained by a partial reaction between a polyester unit and a styrene copolymer resin unit is a resin to be preferably used.

A monomer of which the polyester unit in the above polyester resin or in the above hybrid resin is constituted is, for example, any one of the following compounds.

Examples of alcohol components include the following: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and bisphenol derivatives represented by the following formula (I-1) and derivatives thereof; and diols represented by the following formula (I-2).

Formula (I-1)

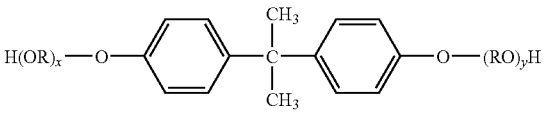

[Chem 1]

(In the formula, R denotes an ethylene group or a propylene group, x and y denote an integer of 1 or more, respectively, and an average value of x and y is 2 to 10.)

Formula (I-2)

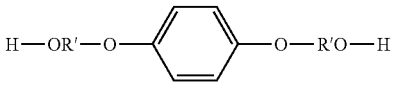

(In the formula, R' represents —$CH_2CH_2$—, —$CH_2$—CH($CH_3$)—, or —$CH_2$—C($CH_3$)$_2$—.)

Examples of acid components include the following: benzenedicarboxylic acids such as phthalic acid, terephthalic acid, isophthalic acid, and phthalic anhydride, or anhydrides thereof; alkyldicarboxylic acids such as succinic acid, adipic acid, sebacic acid, and azelaic acid, or anhydrides thereof; succinic acids substituted with an alkyl group or an alkenyl group having carbon atoms of 6 or more and less than 18, or anhydrides thereof; and unsaturated dicarboxylic acids such as fumaric acid, maleic acid, citraconic acid, and itaconic acid, or anhydrides thereof.

In addition, the above polyester resin or the above polyester unit preferably contains a crosslinked structure based on a polyvalent carboxylic acid which is trivalent or more or an anhydride of the acid and/or a polyhydric alcohol which is trihydric or more. Examples of the polyvalent carboxylic acid which is trivalent or more or the anhydride of the acid include 1,2,4-benzenetricarboxylic acid, 1,2,4-cyclohexanetricarboxylic acid, 1,2,4-naphthalenetricarboxylic acid, and pyromellitic acid, and anhydrides or lower alkyl esters of these acids. Examples of the polyhydric alcohol which is trihydric or more include 1,2,3-propanetriol, trimethylolpropane, hexanetriol, and pentaerythritol. Of those, aromatic alcohols such as 1,2,4-benzenetricarboxylic acid and an anhydride of the acid are particularly preferable because each of them shows high friction stability between its molecules due to environmental fluctuation.

A vinyl monomer of which the above styrene copolymer resin or the above styrene copolymer resin unit of the hybrid resin is constituted is, for example, any one of the following compounds.

Examples include: styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and acrylate or methacrylate derivatives such as acrylonitrile, methacrylonitrile, and acrylamide.

The examples further include: unsaturated dibasic acids such as maleic acid, citraconic acid, itaconic acid, an alkenylsuccinic acid, fumaric acid, and mesaconic acid; unsaturated dibasic acid anhydrides such as maleic anhydride, citraconic anhydride, itaconic anhydride, and an alkenylsuccinic anhydride; unsaturated dibasic acid half esters such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenylsuccinic acid methyl half ester, fumaric acid methyl half ester, and mesaconic acid methyl half ester; unsaturated dibasic acid esters such as dimethyl maleate and dimethyl fumarate; α, β-unsaturated acids such as acrylic acid, methacrylic acid, crotonic acid, and cinnamic acid; α, β-unsaturated acid anhydrides such as crotonic anhydride and cinnamic anhydride, and anhydrides of the α, β-unsaturated acids and lower fatty acids; and monomers each having a carboxyl group such as an alkenylmalonic acid, an alkenylglutaric acid, and an alkenyladipic acid, and anhydrides and monoesters of these acids.

The examples further include: acrylates or methacrylates such as 2-hydroxyethyl acrylate, 2-hydroxyethyl methacrylate, and 2-hydroxypropyl methacrylate; and monomers each having a hydroxy group such as 4-(1-hydroxy-1-methylbutyl)styrene and 4-(1-hydroxy-1-methylhexyl)styrene.

The styrene copolymer resin or the styrene copolymer resin unit may have a crosslinked structure in which its molecules are crosslinked with a crosslinking agent having two or more vinyl groups. Examples of the crosslinking agent to be used in the case include: aromatic divinyl compounds (such as divinylbenzene and divinylnaphthalene); diacrylate compounds bonded with an alkyl chain (such as ethylene glycol diacrylate, 1,3-butylene glycol diacrylate, 1,4-butanediol diacrylate, 1,5-pentanediol acrylate, 1,6-hexanediol diacrylate, neopentyl glycol diacrylate, and those obtained by replacing the "acrylate" of each of the compounds with "methacrylate"); diacrylate compounds bonded with an alkyl chain containing an ether bond (such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those obtained by replacing the "acrylate" of each of the compounds with "methacrylate"); diacrylate compounds bonded with a chain containing an aromatic group and an ether bond (such as polyoxyethylene(2)-2,2-bis(4-hydroxyphenyl)propane diacrylate, polyoxyethylene(4)-2,2-bis(4-hydroxyphenyl)propane diacrylate, and those obtained by replacing the "acrylate" of each of the compounds with "methacrylate"); and polyester-type diacrylate compounds (for example, trade name "MANDA", available from Nippon Kayaku Co., Ltd.).

Examples of polyfunctional crosslinking agents include the following: pentaerythritol triacrylate, trimethylolethane triacrylate, trimethylolpropane triacrylate, tetramethylolmethane tetraacrylate, oligoester acrylate, and those obtained by replacing the "acrylate" of each of the compounds with "methacrylate"; and triallyl cyanurate and triallyl trimellitate.

These crosslinking agents can be used in an amount of preferably 0.01 parts by mass or more and 10.0 parts by mass or less, more preferably 0.03 parts by mass or more and 5 parts by mass or less with respect to 100 parts by mass of monomer components.

Of those crosslinking agents, for example, the aromatic divinyl compounds (especially divinylbenzene) and the diacrylate compounds each composed of two acrylates bonded to each other through a chain containing an aromatic group and an ether bond are each suitably used in the binder resin in terms of the fixing performance and offset resistance of the toner.

Examples of polymerization initiators used for polymerizing the above styrene copolymer resin or styrene copolymer resin unit include the following: 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)isobutyronitrile, 2,2'-azobis(2,4,4-trimethylpentane), 2-phenylazo-2,4-dimethyl-4-methoxyvaleronitrile, and 2,2'-azobis(2-methylpropane); ketone peroxides such as methyl ethyl ketone peroxide, acetylacetone peroxide, and cyclohexanone peroxide; and 2,2-bis(tert-butylperoxy)butane, tert-butyl hydroperoxide, cumene hydroperoxide, 1,1,3,3-tetramethylbutyl hydroperoxide, di-tert-butyl peroxide, tert-butylcumyl peroxide, dicumyl peroxide, α,α'-bis(tert-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-toluoyl peroxide, diisopropyl peroxydicarbonate, di-2-ethylhexyl peroxydicarbonate, di-n-propyl peroxydicarbonate, di-2-ethoxyethyl peroxydicarbonate, dimethoxyisopropyl peroxydicarbonate, di(3-methyl-3-methoxybutyl) peroxycarbonate, acetylcyclohexylsulfonyl peroxide, tert-butyl peroxyacetate, tert-butyl peroxyisobutyrate, tert-butyl peroxyneodecanoate, tert-butyl peroxy-2-ethylhexanoate, tert-butyl peroxylaurate, tert-butyl peroxybenzoate, tert-butylperoxyisopropyl carbonate, di-tert-butyl peroxyisophthalate, tert-butyl peroxyallylcarbonate, tert-amyl peroxy-2-ethylhexanoate, di-tert-butyl peroxyhexahydroterephthalate, and di-tert-butyl peroxyazelate.

When the hybrid resin is used as the binder resin, the styrene copolymer resin unit and/or the polyester unit each preferably contain/preferably contains a monomer component that can react with both the units. A monomer of which the polyester unit is constituted and which can react with the styrene copolymer resin unit is, for example, an unsaturated dicarboxylic acid such as phthalic acid, maleic acid, citraconic acid, or itaconic acid, or an anhydride of the acid. A monomer of which the styrene copolymer resin unit is constituted and which can react with the polyester unit is, for example, a unit having a carboxyl group or a hydroxy group, or any one of the acrylates and methacrylates.

The product of a reaction between the styrene copolymer resin unit and the polyester unit is preferably obtained by the following method: one, or both, of the styrene copolymer resin unit and the polyester unit is, or are each, subjected to a polymerization reaction in the presence of a polymer containing any such monomer component that can react with each of the units as exemplified above.

In the hybrid resin, a mass ratio between the polyester unit and the styrene copolymer resin unit is preferably 50/50 to 90/10, or more preferably 60/40 to 85/15. When the ratio between the polyester unit and the styrene copolymer resin unit falls within the above range, the toner easily obtains good triboelectric charging performance, and the storage stability of the toner and the dispersing ability of a release agent easily become suitable.

In addition, the tetrahydrofuran (THF) soluble matter of the above binder resin has a weight-average molecular weight Mw measured by gel permeation chromatography (GPC) of preferably 5,000 or more and 1,000,000 or less, and a ratio Mw/Mn of the weight-average molecular weight Mw to a number average molecular weight Mn of the matter of preferably 1 or more and 50 or less from the viewpoint of the fixing performance of the toner.

In addition, the above binder resin has a glass transition temperature of preferably 45° C. or higher and 60° C. or lower, or more preferably 45° C. or higher and 58° C. or lower from the viewpoints of the fixing performance and storage stability of the toner.

In addition, any such binder resin as described above may be used alone, or two kinds of the high-softening-point resin (H) and the low-softening-point resin (L) having different softening points may be used as a mixture at a mass ratio H/L in the range of 100/0 to 30/70, or preferably 100/0 to 40/60. The term "high-softening-point resin" refers to a resin having a softening point of 100° C. or higher, and the term "low-softening-point resin" refers to a resin having a softening point lower than 100° C. Such system is preferable because the molecular weight distribution of the magnetic toner can be relatively easily designed, and the magnetic toner can be provided with a wide fixing region. In addition, as long as the mass ratio falls within the above range, the magnetic iron oxide particles can be favorably dispersed in the binder resins because moderate shear is applied to the particles at the time of kneading.

A release agent (wax) can be used in the magnetic toner of the present invention as required in order that releasing ability may be obtained. Preferable examples of the wax include: aliphatic hydrocarbon waxes such as low-molecular weight polyethylene, low-molecular weight polypropylene, a microcrystalline wax, and a paraffin wax due to easiness of dispersion and high releasing ability in the particles of the toner. One or two or more kinds of release agents may be used where necessary. Specific examples include the following.

Oxides of aliphatic hydrocarbon waxes such as a polyethylene oxide wax and block copolymers thereof; waxes mainly composed of fatty acid esters such as a carnauba wax, a sasol wax, and a montanic acid ester wax; and partially or wholly deacidified fatty acid esters such as a deacidified carnauba wax. Further examples of the wax include: straight-chain saturated fatty acids such as palmitic acid, stearic acid, and montanic acid; unsaturated fatty acid esters such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; alkyl alcohols having a long-chain; polyhydric alcohols such as sorbitol; fatty acid amides such as linoleic amide, oleic amide, and lauric amide; saturated fatty acid bis amides such as methylene bis stearamide, ethylene bis capramide, ethylene bis lauramide, and hexamethylene bis stearamide; unsaturated fatty acid amides such as ethylene bis oleamide, hexamethylene bis oleamide, N,N'-dioleyl adipamide, and N,N'-dioleyl sebacamide; aromatic bis amides such as m-xylene bis stearamide and N,N'-distearyl isophthalamide; fatty acid metal salts (what are generally referred to as metallic soaps) such as calcium stearate, calcium laurate, zinc stearate, and magnesium stearate; graft waxes of which aliphatic hydrocarbon waxes are grafted with vinyl monomers such as styrene and acrylic acid; partially esterified compounds of fatty acids and polyhydric alcohols such as behenic monoglyceride; and methyl ester compounds having hydroxyl groups obtained by hydrogenation of vegetable oil.

Examples of a release agent to be particularly preferably used include aliphatic hydrocarbon waxes. The examples of such aliphatic hydrocarbon waxes include the following: a low-molecular weight alkylene polymer obtained by subjecting an alkylene to radical polymerization under high pressure or by polymerizing an alkylene under reduced pressure by using a Ziegler catalyst; an alkylene polymer obtained by thermal decomposition of a high-molecular weight alkylene polymer; a synthetic hydrocarbon wax obtained from a residue on distillation of a hydrocarbon obtained by means of an Age method from a synthetic gas containing carbon monoxide and hydrogen, and a synthetic hydrocarbon wax obtained by hydrogenation of the wax; and those obtained by fractionating those aliphatic hydrocarbon waxes by means of a press sweating method, a solvent method, or vacuum distillation or according to a fractional crystallization method. Of those, a linear, saturated hydrocarbon with a small number of small branches is preferable, and a hydrocarbon of such kind synthesized by a method not based on the polymerization of an alkylene is particularly preferable because of its molecular weight distribution.

Specific examples of a release agent that can be used include the following: BISCOL (registered trademark) 330-P, 550-P, 660-P, and TS-200 (Sanyo Chemical Industries, Ltd.); HIWAX 400P, 200P, 100P, 410P, 420P, 320P, 220P, 210P, and 110P (Mitsui Chemicals, Inc.); SASOL H1, H2, C80, C105, and C77 (Sasol Co.); HNP-1, HNP-3, HNP-9, HNP-10, HNP-11, and HNP-12 (NIPPON SEIRO CO., LTD); UNILIN (registered trademark) 350, 425, 550, and 700, UNISID (registered trademark) 350, 425, 550, and 700 (TOYO-PETROLITE); and a haze wax, a beeswax, a rice wax, a candelilla wax, and a camauba wax (CERARICA NODA Co., Ltd.).

The time at which the release agent is added is appropriately selected from the existing methods. For example, the release agent may be added at the time of melting and kneading during production of the magnetic toner particles, or may be added at the time of production of the binder resin. In addition, one kind of those release agents may be used alone, or two or more kinds of them may be used in combination.

The release agent is preferably added in an amount of 1 part by mass or more and 20 parts by mass or less with respect to 100 parts by mass of the binder resin. As long as the amount falls within the above range, a releasing effect can be sufficiently obtained, the good dispersing ability of the release agent in each of the magnetic toner particles can be obtained, and the adhesion of the magnetic toner to a photosensitive member and the contamination of the surface of a developing member or cleaning member can be suppressed.

A charge control agent can be incorporated into the magnetic toner of the present invention to stabilize the triboelectric chargeability of the toner. An addition amount of charge control agent is generally incorporated into toner particles in an amount of preferably 0.1 parts by mass or more and 10 parts by mass or less, or more preferably 0.1 parts by mass or more and 5 parts by mass or less with respect to 100 parts by mass of the binder resin, although the addition amount varies depending on the kind of the charge control agent, and the physical properties of any other material constituting the magnetic toner particles.

The charge control agent includes one for controlling magnetic toner to be negatively chargeable and one for controlling toner to be positively chargeable. One kind of various charge control agents can be used may be used alone, or two or more kinds of them may be used in combination depending on the kind and applications of the magnetic toner.

Examples of such charge control agent for controlling the magnetic toner to be negatively chargeable include the following: organic metal complexes (such as monoazo metal complexes and acetylacetone metal complexes); and metal complexes or metal salts of aromatic hydroxy-carboxylic acids or aromatic dicarboxylic acids. The examples of such charge control agent for controlling magnetic toner to be negatively chargeable further include: aromatic monocarboxylic and polycarboxylic acids, and metal salts and anhydrates of the acids; esters; and phenol derivatives such as bisphenol. Of those, a metal complex or metal salt of an aromatic hydroxy-carboxylic acid is particularly preferably used because the toner can obtain stable chargeability. In addition, a charge control resin as well as each of the above-mentioned charge control agents can be used.

Examples of a charge control agent for controlling the magnetic toner to be positively chargeable include the following: nigrosin and modified products of nigrosin with metal salts of fatty acids; quaternary ammonium salts such as tributylbenzyl ammonium-1-hydroxy-4-naphtosulfonate and tetrabutyl ammonium tetrafluoroborate, and analogs of the salts; onium salts such as phosphonium salts and lake pigments of the salts; triphenyl methane dyes and lake pigments of the dyes (lake agents include phosphotungstic acid, phosphomolybdic acid, phosphotungsten molybdic acid, tannic acid, lauric acid, gallic acid, ferricyanic acid, and ferrocyanide); and metal salts of higher fatty acids. In the present invention, one kind of them may be used alone, or two or more kinds of them may be used in combination. Of those, a nigrosin compound, a quaternary ammonium salt, or the like is particularly preferably used.

Specific examples of a charge control agent that can be used include the following. A charge control agent for negative charging include: SPILON BLACK TRH, T-77, and T-95 (Hodogaya Chemical Co., Ltd.); and BONTRON (registered trademark)S-34, S-44, S-54, E-84, E-88, and E-89 (Orient Chemical Industries, LTD.). Preferable examples of a charge control agent for positive charging include: TP-302 and TP-415 (Hodogaya Chemical Co., Ltd.); BONTRON (registered trademark) N-01, N-04, N-07, and P-51 (Orient Chemical Industries, LTD.); and COPY BLUE PR (Clariant).

In addition, an external additive is preferably added to each of the magnetic toner particles in the magnetic toner for improving the charging stability, developing ability, flowability, and durability of the toner; it is particularly preferable that a silica fine powder be externally added to each of the particles.

The silica fine powder is preferably a powder having a specific surface area based on a BET method by nitrogen adsorption in the range of 30 m2/g or more (or particularly preferably 50 m2/g or more and 400 m2/g or less). The silica fine powder is used in an amount of preferably 0.01 part by mass or more and 8.00 parts by mass or less, or more preferably 0.10 part by mass or more and 5.00 parts by mass or less with respect to 100 parts by mass of the magnetic toner particles. The BET specific surface area of the silica fine powder can be calculated with, for example, a specific surface area measuring apparatus AUTOSORB 1 (manufactured by Yuasa Ionics Inc.), GEMINI 2360/2375 (manufactured by Micromeritics Instrument Corporation), or TRISTAR 3000 (manufactured by Micromeritics Instrument Corporation) by employing a BET multipoint method while causing a nitrogen gas to adsorb to the surface of the silica fine powder.

In addition, the silica fine powder is preferably treated with any one of the treatment agents such as unmodified silicone varnishes, various modified silicone varnishes, unmodified silicone oils, various modified silicone oils, silane coupling agents, silane compounds each having a functional group, and other organic silicon compounds for the purposes of making the powder hydrophobic and controlling the triboelectric chargeability of the toner.

In addition, any other external additive may be added to the magnetic toner as required. Examples of the external additive include resin fine particles and inorganic fine particles serving as charging adjuvants, conductivity-imparting agents, flowability-imparting agents, caking inhibitors, release agents for heat rollers, lubricants, and abrasives.

Examples of the lubricant include a polyethylene fluoride powder, a zinc stearate powder, and a polyvinylidene fluoride powder. Of those, the polyvinylidene fluoride powder is preferable.

In addition, examples of the abrasive include a cerium oxide powder, a silicon carbide powder, and a strontium titanate powder. Of those, the strontium titanate powder is preferable.

Examples of the flowability-imparting agent include a titanium oxide powder and an aluminum oxide powder. Of those, a powder subjected to a hydrophobic treatment is preferable.

Examples of the conductivity-imparting agent include a carbon black powder, a zinc oxide powder, an antimony oxide powder, and a tin oxide powder.

In addition, a small amount of white and black fine particles opposite in polarity to each other can be further used as a developing performance improver.

A method of producing the magnetic toner of the present invention is not particularly limited, and a known method can be employed.

An example of the production of the toner by a pulverization method will be described below. However, the present invention is not limited to the following.

First, the magnetic toner particles can be obtained by: sufficiently mixing a binder resin and a magnetic iron oxide particle, and where required, a colorant, any other additive, and the like by using a mixer such as a HENSCHEL mixer or a ball mill; melting and kneading the mixture by using a heat kneader such as a heat roll, a kneader, or an extruder; cooling the kneaded product to be solidified; and grinding and classifying the solidified product. Further, the magnetic toner can be obtained by sufficiently mixing an external additive with the magnetic toner particles by using a mixer such as a HENSCHEL mixer as required.

Examples of the mixer include the following: HENSCHEL mixer (manufactured by MITSUI MINING CO., LTD.); SUPER mixer (manufactured by KAWATA MFG Co., Ltd.); RIBOCONE (manufactured by OKAWARA MFG. CO., LTD.); NAUTA mixer, TURBULIZER, and CYCLOMIX (manufactured by Hosokawa Micron Corporation); SPIRAL PIN mixer (manufactured by Pacific Machinery & Engineering Co., Ltd.); and REDIGE mixer (manufactured by MATSUBO Corporation).

Further, examples of the kneader include the following: KRC kneader (manufactured by KURIMOTO, LTD.); BUSS-CO-Kneader (manufactured by Coperion BUSS AG); TEM extruder (manufactured by TOSHIBA MACHINE CO., LTD.); TEX twin screw kneader (manufactured by The Japan Steel Works, LTD.); PCM kneader (manufactured by Ikegai, Ltd.); Three roll mill, Mixing roll mill, and Kneader (manufactured by INOUE MFG., INC.); KNEADEX (manufactured by MITSUI MINING CO., LTD.); MS type pressurizing kneader, and KNEADER RUDER (manufactured by Moriyama Co., Ltd.); and BANBURY mixer (manufactured by Kobe Steel, Ltd.).

Further, examples of the pulverizer include the following: COUNTER JET MILL, MICRON JET, and INOMIZER (manufactured by Hosokawa Micron Corporation); IDS type mill, and PJM jet pulverizer (manufactured by Nippon Pneumatic Mfg. Co., Ltd.); CROSSJET MILL (manufactured by KURIMOTO, LTD.); ULMAX (manufactured by NISSO ENGINEERING CO., LTD.); SK JET-O-MILL (manufactured by Seishin Enterprise Co., Ltd.); CLIPTRON (manufactured by Kawasaki Heavy Industries, Ltd.); TURBO MILL (manufactured by Turbo Kogyo Co., Ltd.); and SUPER ROTOR (manufactured by Nisshin Engineering Inc.).

Further, examples of the classifier include the following: CLASSIEL, MICRON CLASSIFIER, and SPEDIC CLASSIFIER (manufactured by Seishin Enterprise Co., Ltd.); TURBO CLASSIFIER (manufactured by Nisshin Engineering Inc.); MICRON SEPARATOR, TURBOPLEX (ATP), and TSP SEPARATOR (manufactured by Hosokawa Micron Corporation); ELBOW-JET (manufactured by Nittetsu Mining Co., Ltd.); DISPERSION SEPARATOR (manufactured by Nippon Pneumatic Mfg. Co., Ltd.); and YM MICROCUT (manufactured by YASUKAWA ELECTRIC CORPORATION). Further, examples of the screening device for sifting coarse particles or the like include the following: ULTRA SONIC (manufactured by Koei Sangyo Co., Ltd.); RESONA SIEVE, and GYRO SIFTER (manufactured by Tokuju Corporation); VIBRASONIC System (manufactured by Dalton Corporation); SONICLEAN (manufactured by Sintokogio, Ltd.); TURBO SCREENER (manufactured by Turbo Kogyo Co., Ltd.); and MICRO SIFTER (manufactured by Makino Mfg. Co., Ltd.); Circular form vibration sieve.

Methods of measuring physical properties related to the magnetic toner of the present invention are as described below. Examples to be described later are also based on these methods.

(1) Method of Determining Ratio X of Amount of Fe(2+) in Solution Having Fe Element-Dissolving Ratio of 10 Mass % to Fe Element Amount in Solution Having Fe Element-Dissolving Ratio of 10 Mass %

25 g of magnetic iron oxide particles each serving as a sample are added to 3.8 liters of deionized water, and the mixture is stirred at a stirring speed of 200 revolutions/min while its temperature is kept at 40° C. in a water bath. 1,250 ml of an aqueous solution of hydrochloric acid prepared by dissolving 424 ml of a reagent grade hydrochloric acid reagent (having a concentration of 35%) in deionized water are added to the resultant slurry to dissolve the magnetic iron oxide particles while the mixture is stirred. 50 ml of the aqueous solution of hydrochloric acid are sampled together with the magnetic iron oxide particles dispersed in the solution every 10 minutes from the initiation of the dissolution until all the magnetic iron oxide particles are dissolved so that the solution becomes transparent. Immediately after that, the sampled solution is filtrated through a membrane filter having a pore size of 0.1 μm, and the filtrate is collected. The amount of an Fe element is determined by using 25 ml of the collected filtrate with an inductively coupled plasma (ICP) emission analyzer (ICP-S2000, manufactured by Shimadzu Corporation). Then, a ratio (Fe element-dissolving ratio, mass %) of an Fe element amount in each recovered solution (filtrate sample) to an Fe element amount in a solution in which all the magnetic iron oxide particles are dissolved (total Fe element amount) is calculated from the following equation.

$$\text{Fe element-dissolving ratio (mass \%)} = \frac{\text{concentration of iron element in collected sample (mg/l)}}{\text{concentration of iron element when magnetic iron oxide particles are completely dissolved (mg/l)}} * 100 \quad \text{[Num 1]}$$

In addition, the concentration of Fe(2+) in each solution is measured by using the remaining 25 ml of the collected filtrate sample. A sample is prepared by adding 75 ml of deionized water to 25 ml of the filtrate, and sodium diphenylamine sulfonate is added as an indicator to the sample. Then, the sample is subjected to oxidation-reduction titration with 0.05-mol/l potassium dichromate, and a titer is determined by defining the amount of potassium dichromate in which the sample is stained violet as an endpoint. Then, the concentration of Fe(2+) (mg/l) is calculated from the titer.

A ratio (mass %) of the amount of Fe(2+) at the time point when each collected solution (filtrate) is collected is calculated from the following equation by using the concentration of an Fe (iron) element in the solution (filtrate sample) determined by the above method and the concentration of Fe(2+) determined from the filtrate sample at the same time point.

$$\text{Ratio of Fe (2+) (\%)} = \frac{\text{(concentration of Fe (2+) in collected sample (mg/l)}}{\text{(concentration of iron element in collected sample (mg/l)}} \times 100 \quad \text{[Num 2]}$$

Then, an Fe element-dissolving ratio and the ratio of the amount of Fe(2+) obtained for each collected solution (filtrate sample) are plotted, and the respective points are smoothly connected to each other so that an Fe element-dissolving ratio versus Fe(2+) amount ratio graph is created. A ratio of the amount of Fe(2+) in a solution having an Fe element-dissolving ratio of 10 mass % to an Fe element amount in the solution having an Fe element-dissolving ratio of 10 mass %, that is, the ratio X (mass %) of the amount of Fe(2+) in the solution having an Fe element-dissolving ratio of 10 mass % to the Fe element amount in the solution having an Fe element-dissolving ratio of 10 mass % is determined by using the graph.

(2) Method of Determining Dielectric Loss Tangent of Magnetic Toner

The dielectric loss tangent of the magnetic toner is determined as described below. A 4284A Precision LCR Meter (manufactured by Hewlett-Packard Company) is calibrated at frequencies of 1,000 Hz and 1 MHz. After that, the complex dielectric constants of the toner at frequencies of 10,000 Hz and 1,000 Hz are measured with the apparatus. Then, the dielectric loss tangent ($\tan \delta = \in''/\in'$) is calculated from the resultant measured values. The preparation and setting of a sample were performed as described below.

1.0 g of the magnetic toner is weighed, and is molded into a disk-like measurement sample having a diameter of 25 mm and a thickness of 2 mm or less (preferably 0.5 mm or more and less than 1.5 mm) while a load of 19,600 kPa (200 kgf/cm$^2$) is applied to the toner for 1 minute. The measurement sample is mounted in an ARES (manufactured by Rheometric Scientific F. E. Ltd.) mounted with a dielectric constant measuring jig (electrode) having a diameter of 25 mm, is heated to a temperature of 70° C., and is fixed. After that, the sample is cooled to a temperature of 40° C. The dielectric loss tangent can be obtained by measuring the dielectric constants of the sample at frequencies of 1,000 Hz and 1 MHz and a constant temperature of 40° C. in a state where a load of 0.49 N or more and 1.96 N or less (50 g or more and 200 g or less) is applied to the sample. It should be noted that the measurement temperature, 40° C., corresponds to an ambient temperature in a developing site, and the sample can be evaluated in simulation for state at the time of development by measuring the dielectric characteristics of the sample at the temperature.

(3) Method of Calculating Above Ratio (X/Y)

The ratio X is determined by the above-mentioned method.

The ratio Y is defined as a value (C/D) obtained by dividing the value C obtained by subtracting the amount of Fe(2+) in the above solution having an Fe element-dissolving ratio of 10 mass % from the amount of Fe(2+) in the above solution in which all the magnetic iron oxide particles are dissolved by the value D obtained by subtracting the Fe element amount in the above solution having an Fe element-dissolving ratio of 10 mass % from the above total Fe element amount. That is, the ratio Y is represented by the following equation.

Num 3

$$Y\ (\%) = \frac{\text{concentration of Fe (2+) when magnetic iron oxide particles are completely dissolved} - \text{concentration of Fe (2+) when iron element-dissolving ratio is 10 mass \%}}{\text{concentration of iron element when magnetic iron oxide particles are completely dissolved} - \text{concentration of iron element when iron element-dissolvong ratio is 10 mass \%}} \times 100$$

The ratio (X/Y) is calculated by using the ratios X and Y calculated as described above (that is, by dividing X by Y).

(4) Method of Determining Total Content of Heterogeneous Elements (Such as Silicon) of Magnetic Iron Oxide Particles 26 ml of an aqueous solution of hydrochloric acid in which 16 ml of a reagent grade hydrochloric acid reagent (having a concentration of 35%) are dissolved are added to 1.00 g of a sample (magnetic iron oxide particles), and the sample is dissolved under heat (at 80° C. or lower). After that, the resultant is left standing to cool to room temperature. 4 ml of an aqueous solution of hydrofluoric acid in which 2 ml of a reagent grade hydrofluoric acid reagent (having a concentration of 4%) are dissolved are added to the resultant, and then the mixture is left to stand for 20 minutes. 10 ml of a TRITON X-100 (having a concentration of 10%) (manufactured by ACROS ORGANICS) are added to the resultant, and the mixture is transferred to a 100-ml plastic volumetric flask. Pure water is added to the flask so that the total amount of the solution is adjusted to 100 ml. Thus, a sample solution is prepared.

The amount of heterogeneous elements (such as silicon) in the above sample solution is determined with a plasma emission analyzer ICP-S2000 manufactured by Shimadzu Corporation.

(5) Method of Determining Amount of Heterogeneous Elements (Such as Silicon and Aluminum) in Coat Layers 0.900 g of a sample (magnetic iron oxide particles) is weighed, and 25 ml of a 1-mol/l solution of NaOH are added to the sample. The temperature of the solution is increased to 45° C. while the solution is stirred, whereby heterogeneous elements (such as a silicon component and an aluminum component) on the surfaces of the magnetic iron oxide particles are dissolved. After undissolved matter has been separated by filtration, pure water is added to the eluent so that the volume of the mixture is 125 ml. Thus, a sample solution is prepared. The amount of silicon or aluminum in the sample solution is determined with the above plasma emission analyzer (ICP-S2000). The amount of the heterogeneous elements (such as a silicon component and an aluminum component) in the coat layers of the magnetic iron oxide particles is calculated by using the following equation.

[Num 4]

$$\text{Heterogeneous element component in coat layers (\%)} = \frac{\text{concentration of heterogeneous element in eluent (g/l)} \times 125 \div 1000}{0.900\ \text{(g)}} \times 100$$

(6) Method of Determining Amount of Heterogeneous Elements (Such as Silicon) in Core Particle Portions of Magnetic Iron Oxide Particles A difference between the total content of the heterogeneous elements determined in the above section (4) and the amount of the heterogeneous elements in the coat layers determined in the above section (5) was defined as the amount of the heterogeneous elements in the core particle portions of the magnetic iron oxide particles.

(7) Method of Measuring Number Average Primary Particle Diameter of Magnetic Iron Oxide Particles The magnetic iron oxide particles are observed with a scanning electron microscope (at a magnification of 40,000). The Feret diameters of 200 particles are measured, and the number average particle diameter of the particles is determined. In the present invention, an S-4700 (manufactured by Hitachi, Ltd.) was used as the scanning electron microscope.

(8) Method of Measuring Magnetic Properties

The measurement was performed with an vibrating sample magnetometer VSM-P7 manufactured by TOEI INDUSTRY CO., LTD. at a sample temperature of 25° C. in an external magnetic field of 795.8 kA/m.

(9) Method of Measuring Softening Point of Binder Resin

The softening point of a binder resin is measured with a flowability-evaluating apparatus (flow tester) in adherence to the measurement method described in JIS K 7210. A specific measurement method is shown below.

While a sample having a volume of 1 $cm^3$ is heated with a flowability-evaluating apparatus (Flow Tester CFT-500D manufactured by Shimadzu Corporation) at a rate of temperature increase of 6° C./min, a load of 1,960 $N/m^2$ (20 $kg/cm^2$) is applied to the sample from a plunger so that a nozzle having a diameter of 1 mm and a length of 1 mm is extruded. A plunger fall out amount (flow value)-temperature curve is drawn on the basis of the result of the extrusion. The height of the S-shaped curve is represented by h, and the temperature corresponding to h/2 (the temperature at which one half of the resin flows out) is defined as the softening point.

(10) Method of Measuring Molecular Weight Distribution of Tetrahydrofuran (THF) Soluble Matter of Binder Resin by Means of Gel Permeation Chromatography (GPC)

A column is stabilized in a heat chamber at 40° C. Tetrahydrofuran (THF) as a solvent is allowed to flow into the column at the temperature at a flow rate of 1 ml/min, and about 100 μl of a THF sample solution are injected for measurement. In measuring the molecular weight of the sample, the molecular weight distribution possessed by the sample was calculated from the relationship between a logarithmic value of an analytical curve prepared by several kinds of monodisperse polystyrene standard samples and the number of counts. Examples of standard polystyrene samples for preparing an analytical curve that can be used include samples each having a molecular weight of about $1\times10^2$ or more and $1\times10^7$ or less. At least about ten standard polystyrene samples are suitably used. For example, TSK standard polystyrenes manufactured by TOSOH CORPORATION (F-850, F-450, F-288, F-128, F-80, F-40, F-20, F-10, F-4, F-2, F-1, A-5000, A-2500, A-1000, and A-500) may be used.

In addition, an RI (refractive index) detector is used as a detector. It is recommended that a combination of multiple commercially available polystyrene gel columns are used as the column. Examples of the combination include: a combination of SHODEX GPC KF-801, 802, 803, 804, 805, 806, 807, and 800P (manufactured by Showa Denko K.K.); and a combination of TSK gel G1000H (HXL), G2000H (HXL), G3000H (HXL), G4000H (HXL), G5000H (HXL), G6000H (HXL), G7000H (HXL), and TSK guard column (manufactured by TOSOH CORPORATION).

In addition, the above THF sample solution is prepared as described below. A binder resin is left to stand at a temperature of 25° C. for several hours. After that, the resin and THF are mixed well with each other by being sufficiently shaken (until the aggregate of the sample disappears). Then, the resultant is left at rest for an additional 12 hours or longer. In this case, the time period for which the resin is left to stand in THF is set to 24 hours. After that, the resultant is passed through a sample treatment filter (having a pore size of about 0.5 μm, for example, a MAISHORI DISK H-25-2 (manufactured by TOSOH CORPORATION) is used), and is regarded as a THF sample solution for GPC. In addition, the concentration of the THF sample solution is adjusted so that the concentration of a resin component soluble in THF is 5 mg/ml.

(11) Method of Measuring Glass Transition Temperature of Binder Resin

Measurement is performed by using a differential scanning calorimeter (DSC) "MDSC-2920" (manufactured by TA Instruments) in conformity with ASTM D3418-82 at normal temperature and normal humidity.

2 mg or more and 10 mg or less, or preferably about 3 mg, of a measurement sample are precisely weighed and used. The sample is loaded into an aluminum pan. An empty aluminum pan is used as a reference. The measurement is performed in the measurement temperature range of 30° C. or higher to 200° C. or lower as follows: the temperature of the measurement sample is increased once from 30° C. to 200° C. at a rate of temperature increase of 10° C./min, is then decreased from 200° C. to 30° C. at a rate of temperature decrease of 10° C./min, and is increased again to 200° C. at a rate of temperature increase of 10° C./min. The point of intersection of a line intermediate between a base line before the appearance of a change in specific heat in the DSC curve obtained by the second temperature increase process and a base line after the appearance of the change and the differential thermal curve is defined as a glass transition temperature Tg of a binder resin.

(12) Measurement of Content of THF Insoluble Matter of Binder Resin 1.0 g of a binder resin is weighed (the amount is represented by "W1" g). The weighed resin is placed in extraction thimble (such as No. 86R manufactured by Toyo Roshi), and is set in a Soxhlet extractor so that the resin is subjected to Soxhlet extraction with 200 ml of THF for 20 hours. After that, the extracted component is dried in a vacuum at a temperature of 40° C. for 20 hours, and is then weighed (the amount is represented by "W2" g). The content of THF insoluble matter is calculated in accordance with the following equation.

$$\text{Content of THF insoluble matter (mass \%)}=[(W1-W2)/W1]\times 100$$

DESCRIPTION OF THE EMBODIMENTS

Hereinafter, the present invention will be described specifically by way of examples; provided that an embodiment of the present invention is by no means limited by these examples.

Production Example of Binder Resin A-1

| | |
|---|---|
| Terephthalic acid | 25 mol % |
| Dodecenylsuccinic acid | 15 mol % |
| Trimellitic anhydride | 6 mol % |
| Bisphenol derivative represented by the formula (I-1) (2.5-mol propylene oxide adduct) | 30 mol % |
| Bisphenol derivative represented by the formula (I-1) (2.5-mol ethylene oxide adduct) | 24 mol % |

The above acid components and the above alcohol components as monomers for producing a polyester unit, and tin 2-ethylhexanoate as a catalyst were loaded into a four-necked flask. The flask was mounted with a decompression device, a water-separating device, a nitrogen gas-introducing device, a temperature-measuring device, and a stirring device. While the mixture in the flask was stirred at a temperature of 130° C. under a nitrogen atmosphere, a mixture of 25 parts by mass of the following monomers for producing a styrene copolymer resin unit with respect to 100 parts by mass of the above monomer components for producing a polyester unit and a polymerization initiator (benzoyl peroxide) was dropped from a dropping funnel to the mixture over 4 hours.

| | |
|---|---|
| Styrene | 83 mass % |
| 2-ethylhexyl acrylate | 15 mass % |
| Acrylic acid | 2 mass % |

The above materials were aged for 3 hours while the temperature of the environment surrounding the materials was kept at 130° C. Then, the temperature was increased to 230° C., and the materials were subjected to a reaction. After the completion of the reaction, the product was taken out of the container and pulverized, whereby Binder Resin A-1 containing a polyester resin component, a styrene copolymer component, and a hybrid resin component was obtained. Table 1 shows the physical properties of Binder Resin A-1.

Production Example of Binder Resin A-2

| | |
|---|---|
| Terephthalic acid | 28 mol % |
| Dodecenylsuccinic acid | 12 mol % |
| Trimellitic anhydride | 2 mol % |
| Bisphenol derivatives represented by the formula (I-1) (2.5-mol propylene oxide adduct) | 33 mol % |
| Bisphenol derivatives represented by the formula (I-1) (2.5-mol ethylene oxide adduct) | 25 mol % |

The above acid components and the above alcohol components as monomers for producing a polyester unit, and tin 2-ethylhexanoate as a catalyst were loaded into a four-necked flask. The flask was mounted with a decompression device, a water-separating device, a nitrogen gas-introducing device, a temperature-measuring device, and a stirring device. While the mixture in the flask was stirred at a temperature of 130° C. under a nitrogen atmosphere, a mixture of 25 parts by mass of the following monomers for producing a styrene copolymer resin unit with respect to 100 parts by mass of the above monomer components for producing a polyester unit and a polymerization initiator (benzoyl peroxide) was dropped from a dropping funnel to the mixture over 4 hours.

| | |
|---|---|
| Styrene | 83 mass % |
| 2-ethylhexyl acrylate | 15 mass % |
| Acrylic acid | 2 mass % |

The above materials were aged for 3 hours while the temperature of the environment surrounding the materials was kept at 130° C. Then, the temperature was increased to 230° C., and the materials were subjected to a reaction. After the completion of the reaction, the product was taken out of the container and pulverized, whereby Binder Resin A-2 containing a polyester resin component, a styrene copolymer component, and a hybrid resin component was obtained. Table 1 shows the physical properties of Binder Resin A-2.

Production Example of Binder Resin A-3

| | |
|---|---|
| Terephthalic acid | 30 mol % |
| Dodecenylsuccinic acid | 13 mol % |
| Trimellitic anhydride | 6 mol % |
| Bisphenol derivatives represented by the formula (I-1) (2.5-mol propylene oxide adduct) | 33 mol % |
| Bisphenol derivatives represented by the formula (I-1) (2.5-mol ethylene oxide adduct) | 18 mol % |

The acid components and the alcohol components described above, and tin 2-ethylhexanoate as an esterification catalyst were loaded into a four-necked flask. The flask was mounted with a decompression device, a water-separating device, a nitrogen gas-introducing device, a temperature-measuring device, and a stirring device. Under a nitrogen atmosphere, the temperature of the mixture was increased to 230° C., and the mixture was subjected to a reaction. A degree of polymerization was pursued on the basis of the softening point of the mixture. After the completion of the reaction, the product was taken out of the container, cooled, and pulverized, whereby Binder Resin A-3 was obtained. Table 1 shows the physical properties of Binder Resin A-3.

Production Example of Binder Resin A-4

| | |
|---|---|
| Terephthalic acid | 23 mol % |
| Dodecenylsuccinic acid | 12 mol % |
| Trimellitic anhydride | 13 mol % |
| Bisphenol derivatives represented by the formula (I-1) | 32 mol % |

-continued

| | |
|---|---|
| (2.5-mol propylene oxide adduct) | |
| Bisphenol derivatives represented by the formula (I-1) (2.5-mol ethylene oxide adduct) | 20 mol % |

The acid components and the alcohol components described above, and tin 2-ethylhexanoate as an esterification catalyst were loaded into a four-necked flask. The flask was mounted with a decompression device, a water-separating device, a nitrogen gas-introducing device, a temperature-measuring device, and a stirring device. Under a nitrogen atmosphere, the temperature of the mixture was increased to 230° C., and the mixture was subjected to a reaction. A degree of polymerization was pursued on the basis of the softening point of the mixture. After the completion of the reaction, the product was taken out of the container, cooled, and pulverized, whereby Binder Resin A-4 was obtained. Table 1 shows the physical properties of Binder Resin A-4.

Production Example of Binder Resin A-5

250 parts by mass of degassed water and 50 parts by mass of a 1-mass % aqueous solution of polyvinyl alcohol were charged into a four-necked flask. After that, a mixed liquid of 83 parts by mass of styrene, 17 parts by mass of n-butyl acrylate, 0.001 part by mass of divinylbenzene, and 0.1 part by mass of 2,2-bis(4,4-di-tert-butylperoxycyclohexyl)propane was added to the mixture, and the whole was stirred, whereby a suspension was prepared.

After a nitrogen atmosphere had been established in the four-necked flask, the temperature in the flask was increased to 85° C. so that polymerization was initiated. After the temperature of the resultant had been kept at the temperature for 20 hours, 0.1 part by mass of benzoyl peroxide was further added to the resultant, and the temperature of the mixture was kept at the temperature for an additional 8 hours. Thus, the polymerization was completed.

Next, high-molecular-weight polymer particles were separated by filtration, sufficiently washed with water, and dried, whereby Binder Resin A-5 was obtained. Table 1 shows the physical properties of Binder Resin A-5.

Production Example of Binder Resin A-6

300 parts by mass of xylene were loaded into a four-necked flask, and the air in the container was sufficiently replaced with nitrogen while xylene was stirred. After that, the temperature in the flask was increased so that xylene was refluxed.

Under the reflux, a mixed liquid of 83 parts by mass of styrene, 17 parts by mass of n-butyl acrylate, and 2 parts by mass of di-tert-butyl peroxide was dropped to the flask over 4 hours. After that, the mixture was retained for 2 hours so that polymerization was completed, whereby a low-molecular-weight polymer solution was obtained.

The polymer solution was dried under reduced pressure, whereby Binder Resin A-6 was obtained. Table 1 shows the physical properties of Binder Resin A-6.

Production Example of Binder Resin A-7

Binder Resin A-5 (90 parts by mass) was preliminarily dissolved in a xylene solution. Further, Binder Resin A-6 (10 parts by mass) was added to, mixed with, and dissolved in the mixture, and then the organic solvent was removed by distillation. The resultant resin was pulverized, whereby Binder Resin A-7 was obtained.

Production Example of Binder Resin A-8

Binder Resin A-5 (80 parts by mass) was preliminarily dissolved in a xylene solution. Further, Binder Resin A-6 (20 parts by mass) was added to, mixed with, and dissolved in the mixture, and then the organic solvent was removed by distillation. The resultant resin was pulverized, whereby Binder Resin A-8 was obtained.

Production Example of Binder Resin A-9

Binder Resin A-5 (30 parts by mass) was preliminarily dissolved in a xylene solution. Further, Binder Resin A-6 (70 parts by mass) was added to, mixed with, and dissolved in the mixture, and then the organic solvent was removed by distillation. The resultant resin was pulverized, whereby Binder Resin A-9 was obtained.

TABLE 1

| | Softening point (° C.) | Mw | Mw/Mn | THF insoluble matter (mass %) | Tg (° C.) |
|---|---|---|---|---|---|
| Binder Resin A-1 | 130 | 58000 | 8.3 | 34 | 57.3 |
| Binder Resin A-2 | 96 | 8100 | 2.5 | 0 | 58.1 |
| Binder Resin A-3 | 140 | 152000 | 21.5 | 32 | 59.8 |
| Binder Resin A-4 | 94 | 8500 | 3.5 | 0 | 58.3 |
| Binder Resin A-5 | 143 | 950000 | 18.5 | 35 | 61.0 |
| Binder Resin A-6 | 91 | 11100 | 1.45 | 0 | 60.0 |

Production Example of Magnetic Iron Oxide Particles B-1

50 liters of an aqueous solution of ferrous sulfate containing $Fe^{2+}$ at a concentration of 2.0 mol/l were prepared by using ferrous sulfate. In addition, 10 liters of an aqueous solution of sodium silicate containing $Si^{4+}$ at a concentration of 0.23 mol/l were prepared by using sodium silicate, and the aqueous solution of sodium silicate was added to the aqueous solution of ferrous sulfate. Subsequently, 42 liters of a 5.0-mol/l aqueous solution of NaOH were mixed with the resultant mixed aqueous solution under stirring, whereby ferrous hydroxide slurry was obtained. The pH and temperature of the ferrous hydroxide slurry were adjusted to 12.0 and 90° C., respectively. Then, air was blown into the slurry at a rate of 30 liters/min, and an oxidation reaction was performed until 50% of the molecules of ferrous hydroxide were turned into magnetic iron oxide particles. Subsequently, air was blown into the slurry at a rate of 20 liters/min until 75% of the molecules of ferrous hydroxide were turned into magnetic iron oxide particles. Subsequently, air was blown into the slurry at a rate of 10 liters/min until 90% of the molecules of ferrous hydroxide were turned into magnetic iron oxide particles. Further, on and after the time point when more than 90% of the molecules of ferrous hydroxide were turned into magnetic iron oxide particles, air was blown into the slurry at a rate of 5 liters/min so that the oxidation reaction was completed. Thus, slurry containing core particles each having an octahedral shape was obtained.

94 ml of an aqueous solution of sodium silicate (containing 13.4 mass % of Si) and 288 ml of an aqueous solution of aluminum sulfate (containing 4.2 mass % of Al) were simultaneously charged into the resultant slurry containing the core particles. After that, the temperature of the slurry was adjusted to 80° C., and the pH of the slurry was adjusted to 5 or more and 9 or less with dilute sulfuric acid, whereby coat layers each containing silicon and aluminum were formed on the surfaces of the core particles. The resultant magnetic iron oxide particles were filtrated, dried, and pulverized by ordinary methods, whereby magnetic iron oxide particles B-1 were obtained. Table 3 shows the physical properties of the magnetic iron oxide particles B-1.

Production Examples of Magnetic Iron Oxide Particles B-2 to B-11

Magnetic iron oxide particles B-2 to B-11 were obtained by adjusting production conditions as shown in Table 2 in the production example of the magnetic iron oxide particles B-1. Table 3 shows the physical property values of the magnetic iron oxide particles B-2 to B-11 obtained here.

It should be noted that the respective stages in the flow rate of blown air shown in Table 2 refer to the following states.

First stage: 0% or more and 50% or less of the molecules of ferrous hydroxide are turned into magnetic iron oxide particles.

Second stage: More than 50% and 75% or less of the molecules of ferrous hydroxide are turned into magnetic iron oxide particles.

Third stage: More than 75% and 90% or less of the molecules of ferrous hydroxide are turned into magnetic iron oxide particles.

Fourth stage: More than 90% and up to 100% of the molecules of ferrous hydroxide are turned into magnetic iron oxide particles.

Production Example of Magnetic Iron Oxide Particles B-12

Magnetic iron oxide particles B-12 were obtained in the same manner as in the production example of the magnetic iron oxide particles B-1 except that: the pH of the ferrous hydroxide slurry was adjusted to 12.0; and the oxidation reaction was not performed in multiple stages, but was completed while the temperature of the slurry and the flow rate of blown air were kept at 90° C. and 30 liters/min, respectively. Table 3 shows the physical property values of the magnetic iron oxide particles B-12 obtained here.

Production Examples of Magnetic Iron Oxide Particle B-13

Magnetic iron oxide particle B-13 were obtained in the same manner as in the production example of the magnetic iron oxide particles B-1 except that production conditions were changed as shown in Table 2. Table 3 shows the physical property values of the magnetic iron oxide particle B-13 obtained here.

Production Example of Magnetic Iron Oxide Particles B-14

An aqueous solution of ferrous sulfate having an Fe(2+) concentration of 2.4 mol/l was prepared by using ferrous sulfate. Next, the temperature of the aqueous solution was increased with water vapor and kept at 40° C. or higher. Subsequently, a 5.0-mol/l aqueous solution of NaOH was dropped to the above aqueous solution so that the pH of the mixture became 1.2.0, whereby ferrous hydroxide slurry was obtained. The temperature of the ferrous hydroxide slurry was adjusted to 90° C., and air was blown into the slurry at a rate of 30 liters/min so that an oxidation reaction was performed.

The resultant slurry was filtrated, washed with water, and dried. After that, the resultant was refluxed under heat in a stream of an $H_2$ gas at 280° C. for 2 hours, whereby magnetic iron oxide particles B-14 were obtained. Table 3 shows the physical property values of the magnetic iron oxide particles B-14 obtained here.

EXAMPLE 1

| | |
|---|---|
| Binder Resin A-1 | 90 parts by mass |
| Binder Resin A-2 | 10 parts by mass |
| Magnetic iron oxide particles B-1 | 60 parts by mass |
| Wax b [Fischer-Tropsch wax (highest endothermic peak temperature 105° C., number average molecular weight 1,500, weight-average molecular weight 2,500)] | 4 parts by mass |
| Charge control agent c shown below (negatively chargeable charge control agent) | 2 parts by mass |

TABLE 2

| | Conditions under which core particles are produced | | | | | | | | Conditions for coating treatment | |
|---|---|---|---|---|---|---|---|---|---|---|
| | Solution of water-soluble silicate | | Flow rate of blown air (liters/min) | | | | | | Aqueous solution of sodium silicate | Aqueous solution of aluminum sulfate |
| Magnetic iron oxide particles | Concentration (mol/l) | Amount of solution (liters) | First stage | Second stage | Third stage | Fourth stage | Liquid temperature (° C.) | Reaction pH | Amount of solution (g) | Amount of solution (g) |
| B-1 | 0.23 | 10 | 30 | 20 | 10 | 5 | 90 | 12.0 | 120 | 380 |
| B-2 | 0.41 | 10 | 30 | 20 | 10 | 5 | 90 | 12.0 | 120 | 380 |
| B-3 | 0.30 | 10 | 20 | 13 | 7 | 3 | 90 | 12.5 | 120 | 380 |
| B-4 | 0.25 | 10 | 30 | 20 | 12 | 5 | 90 | 11.5 | 120 | 380 |
| B-5 | 0.10 | 10 | 25 | 20 | 7 | 5 | 90 | 12.5 | 80 | 180 |
| B-6 | 0.28 | 10 | 30 | 20 | 10 | 5 | 90 | 13.0 | 120 | 380 |
| B-7 | 0.23 | 10 | 20 | 13 | 5 | 2 | 90 | 12.5 | 120 | 380 |
| B-8 | 0.47 | 10 | 10 | 5 | 4 | 3 | 90 | 13.5 | 120 | 380 |
| B-9 | 0.22 | 10 | 30 | 20 | 12 | 5 | 90 | 13.5 | 120 | 380 |
| B-10 | 0.46 | 10 | 30 | 20 | 12 | 5 | 90 | 11.0 | 120 | 380 |
| B-11 | 0.80 | 10 | 30 | 25 | 15 | 5 | 90 | 10.5 | 20 | 40 |
| B-12 | 0.23 | 10 | 30 | 30 | 30 | 30 | 90 | 12.0 | 120 | 380 |
| B-13 | 0.32 | 10 | 10 | 5 | 20 | 30 | 90 | 12.0 | 120 | 380 |

TABLE 3

| | | | | | | Core particle | Coat layer | |
|---|---|---|---|---|---|---|---|---|
| Magnetic iron oxide particles | Particle shape | Average primary particle diameter (μm) | Ratio of Fe(2+) when Fe element-dissolving ratio is 10% (%) | Fe(2+) ratio of surfaces of magnetic iron oxide particles to insides of the particles X/Y | Intensity of magnetization ($Am^2/kg$) | Silicon content (%) | Silicon content (%) | Aluminum content (%) |
| B-1 | Octahedral | 0.15 | 36 | 1.16 | 89.3 | 0.72 | 0.18 | 0.19 |
| B-2 | Octahedral | 0.14 | 37 | 1.10 | 86.5 | 0.78 | 0.20 | 0.18 |
| B-3 | Octahedral | 0.20 | 44 | 1.28 | 86.2 | 0.75 | 0.20 | 0.19 |
| B-4 | Octahedral | 0.10 | 34 | 0.96 | 87.7 | 0.73 | 0.17 | 0.20 |
| B-5 | Octahedral | 0.22 | 40 | 1.20 | 88.5 | 0.25 | 0.12 | 0.11 |
| B-6 | Octahedral | 0.31 | 38 | 1.00 | 87.1 | 0.79 | 0.21 | 0.19 |
| B-7 | Octahedral | 0.26 | 45 | 1.35 | 89.1 | 0.71 | 0.18 | 0.17 |
| B-8 | Octahedral | 0.33 | 49 | 1.03 | 85.3 | 0.82 | 0.15 | 0.16 |
| B-9 | Octahedral | 0.35 | 36 | 0.94 | 88.4 | 0.69 | 0.14 | 0.19 |
| B-10 | Octahedral | 0.11 | 35 | 0.93 | 85.6 | 0.81 | 0.16 | 0.15 |
| B-11 | Octahedral | 0.09 | 34 | 0.92 | 84.3 | 1.82 | 0.04 | 0.03 |
| B-12 | Octahedral | 0.15 | 28 | 0.95 | 88.1 | 0.74 | 0.17 | 0.19 |
| B-13 | Octahedral | 0.16 | 25 | 0.65 | 85.4 | 0.77 | 0.17 | 0.17 |
| B-14 | Octahedral | 0.25 | 27 | 0.98 | 81.2 | — | — | — |

Charge control agent c

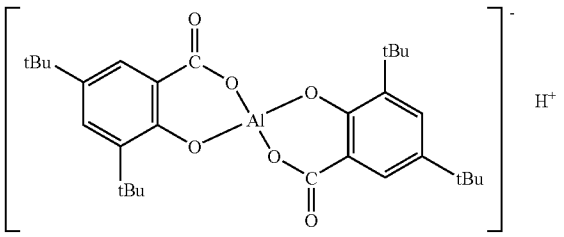

[Chem 2]

The above-mentioned materials were premixed by using a HENSCHEL mixer. After that, the mixture was melted and kneaded by using a biaxial kneading extruder. At this time, a residence time was controlled in such a manner that the temperature of the kneaded resin would be 150° C.

The resultant kneaded product was cooled and coarsely ground by using a hammer mill. After that, the coarsely ground product was ground by using a turbo mill, and the resultant finely ground powder was classified by using a multi-division classifier utilizing a Coanda effect, whereby negatively chargeable magnetic toner particles having a weight average particle diameter (D4) of 5.8 μm were obtained. 1.0 part by mass of a hydrophobic silica fine powder (BET specific surface area 140 $m^2/g$, hydrophobic treatment with 30 parts by mass of hexamethyldisilazane (HMDS) and 10 parts by mass of dimethyl silicone oil with respect to 100 parts by mass of a silica matrix) and 3.0 parts by mass of strontium titanate (number average particle diameter of 1.2 μm) were externally added to and mixed with 100 parts by mass of the magnetic toner particles, and the mixture was sieved by using a mesh having an aperture of 150 μm, whereby negatively chargeable Magnetic Toner 1 was obtained. Results of the measurement of the dielectric loss tangent of Magnetic Toner 1 are shown in the table 4.

Magnetic Toner 1 was incorporated into a commercially available copying machine (iR-6570 manufactured by Canon Inc.), and 100,000-sheet continuous printing was performed by using a test chart having a print percentage of 5% under each of a high-temperature, high-humidity environment (30° C., 80% RH), a normal-temperature, normal-humidity environment (23° C., 50% RH), and a normal-temperature, low-humidity environment (23° C., 5% RH). Then, the toner was evaluated for the following items. Tables 5 to 7 show the results of the evaluation.

(Image Density)

The toner was evaluated for image density as described below. The reflection density of a circular image of 5 mm in diameter was measured with a MACBETH densitometer (manufactured by GretagMacbeth) by using an SPI filter. The evaluation was performed under each test environment at an initial stage (10-th sheet) and after the printing of 100,000 sheets.

(Fogging)

The toner was evaluated for fogging on the basis of a fogging amount Ds-Dr obtained by subtracting an average reflection density Dr of a transfer material before the formation of an image measured with a reflection densitometer (REFLECTOMETER MODEL TC-6DS manufactured by Tokyo Denshoku CO., LTD.) from a worst value Ds for the reflection density of a white portion after the formation of the image measured with the same reflection densitometer. The evaluation was performed under each test environment after the printing of 100,000 sheets while the frequency of the developing bias of the above evaluation machine was changed to 1.2 kHz, 2.7 kHz, and 3.5 kHz. It should be noted that the smaller the numerical value for the fogging amount, the larger the extent to which fogging is suppressed.

(Measurement of Color Tone)

In the measurement of the color tone of the toner, under a normal-temperature, normal-humidity environment, a halftone image having a toner transmission density from which the transmission density of paper had been subtracted of 0.50 or more and 0.90 or less was output on A4-size office planner paper (manufactured by Canon Marketing Japan Inc.; 64 $g/m^2$) by using the above evaluation machine after the printing of 100,000 sheets.

It should be noted that the transmission density was measured with a MACBETH transmission densitometer TD904 (manufactured by GretagMacbeth) under the following conditions. The average of the transmission densities of five points in a portion where an image had been formed was represented by Ts, the average of the transmission densities of five points in a transfer material before the formation of the image was represented by Tr, and the toner was evaluated for color tone on the basis of a transmission density Ts-Tr.

<Conditions for Measurement of Transmission Density>

Light source: halogen lamp HLX64610 (50 W/12 V, manufactured by OSRAM Ltd.)

Filter: visual

The a value and b value of the image in CIE Lab measurement were measured. The smaller each of the a value and the b value, the stronger the black tinge of the image.

A SPECTROLINO manufactured by GretagMacbeth was used in the CIE Lab measurement. Specific measurement conditions are shown below.

<Conditions for Measurement of Color Tone>

| | |
|---|---|
| Observation light source: | D50 |
| Observation view angle: | 2° |
| Density: | DIN |
| White reference: | Abs |
| Filter: | No |

(Image Density Unevenness)

Halftone images with their densities at which laser light was written on a latent image bearing member changed to 20%, 35%, 50%, 65%, 80%, and 100% in a stepwise manner were output, and were each visually evaluated for density unevenness in accordance with the following evaluation criteria. The evaluation was performed under each test environment after the printing of 100,000 sheets.

[Evaluation Criteria]

A (very good): No density unevenness occurs.

B (good): Slight density unevenness is observed when an image is carefully observed.

C (normal): Density unevenness is observed, but does not affect an image.

D (bad): Density unevenness can be clearly observed with the eyes, and an image failure is remarkable.

EXAMPLES 2 TO 16

Magnetic Toners 2 to 16 were each obtained in the same manner as in Example 1 except that a formulation shown in Table 4 was adopted. Each of the resultant magnetic toners was evaluated for the same items as those of Example 1. Tables 4 to 7 show the results.

It should be noted that a wax a, and charge control agents a and b shown in Table 4 are the following compounds.

Wax a: paraffin wax (highest endothermic peak temperature 75° C., number average molecular weight 800, weight-average molecular weight 1,100)

Charge control agent a

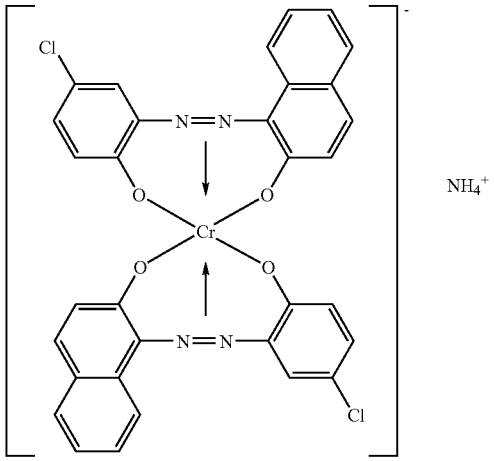

[Chem 3]

-continued

Charge control agent b

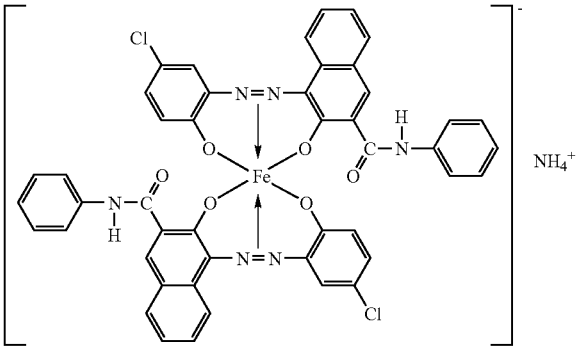

[Chem 4]

COMPARATIVE EXAMPLES 1 TO 4

Magnetic Toners 17 to 20 were each obtained in the same manner as in Example 1 except that a formulation shown in Table 4 was adopted. Each of the resultant magnetic toners was tested for the same items as those of Example 1. Tables 4 to 7 show the results.

TABLE 4

| | | | Binder resins | | | | | | Charge control | | | | |
|---|---|---|---|---|---|---|---|---|---|---|---|---|---|
| | | | Resin (1) | | Resin (2) | | Wax | | agent | | Dielectric loss tangents at 40° C. | | |
| | Toner No. | Magnetic iron oxide particles | Addition amount (parts) | Kind | Addition amount (parts) | Kind | Addition amount (parts) | Kind | Addition amount (parts) | Kind | Addition amount (parts) | Frequency 10000 HZ A | Frequency 1000 Hz B | A/B |
| Example 1 | 1 | B-1 | 60 | A-1 | 90 | A-2 | 10 | b | 4 | c | 2 | $3.93 \times 10^{-3}$ | $6.46 \times 10^{-3}$ | 0.61 |
| Example 2 | 2 | B-1 | 75 | A-1 | 90 | A-2 | 10 | b | 4 | c | 2 | $3.85 \times 10^{-3}$ | $5.35 \times 10^{-3}$ | 0.72 |
| Example 3 | 3 | B-1 | 60 | A-1 | 100 | — | — | a/b | 4/2 | c | 2 | $5.25 \times 10^{-5}$ | $6.36 \times 10^{-5}$ | 0.83 |
| Example 4 | 4 | B-2 | 60 | A-3 | 90 | A-4 | 10 | b | 4 | c | 2 | $4.47 \times 10^{-3}$ | $7.24 \times 10^{-3}$ | 0.62 |
| Example 5 | 5 | B-1 | 60 | A-7 | 100 | — | — | b | 4 | b | 2 | $4.98 \times 10^{-3}$ | $7.83 \times 10^{-3}$ | 0.64 |
| Example 6 | 6 | B-3 | 60 | A-1 | 95 | A-2 | 5 | a | 2 | b | 2 | $1.23 \times 10^{-5}$ | $2.11 \times 10^{-5}$ | 0.58 |
| Example 7 | 7 | B-5 | 60 | A-3 | 95 | A-4 | 5 | a | 2 | c | 2 | $2.33 \times 10^{-5}$ | $2.11 \times 10^{5}$ | 1.10 |
| Example 8 | 8 | B-6 | 60 | A-8 | 100 | — | — | b | 3 | a | 2 | $9.15 \times 10^{-3}$ | $1.41 \times 10^{-3}$ | 6.48 |
| Example 9 | 9 | B-1 | 75 | A-1 | 70 | A-2 | 30 | b | 4 | c | 2 | $9.85 \times 10^{-3}$ | $8.45 \times 10^{-3}$ | 1.17 |
| Example 10 | 10 | B-10 | 60 | A-3 | 40 | A-4 | 60 | a/b | 4/2 | a | 2 | $2.12 \times 10^{-2}$ | $5.14 \times 10^{-2}$ | 0.41 |
| Example 11 | 11 | B-7 | 60 | A-3 | 100 | — | — | b | 3 | c | 2 | $4.05 \times 10^{-6}$ | $3.23 \times 10^{-5}$ | 0.13 |
| Example 12 | 12 | B-4 | 60 | A-1 | 100 | — | — | a | 3 | c | 2 | $4.56 \times 10^{-6}$ | $1.52 \times 10^{-5}$ | 3.00 |
| Example 13 | 13 | B-8 | 60 | A-7 | 100 | — | — | a/b | 3/2 | b | 2 | $8.53 \times 10^{-2}$ | $9.53 \times 10^{-3}$ | 8.95 |
| Example 14 | 14 | B-9 | 60 | A-3 | 35 | A-4 | 65 | b | 4 | b | 2 | $9.83 \times 10^{-2}$ | $1.03 \times 10^{-2}$ | 9.54 |
| Example 15 | 15 | B-11 | 60 | A-9 | 100 | — | — | b | 4 | a | 2 | $9.32 \times 10^{-2}$ | $9.22 \times 10^{-2}$ | 1.01 |
| Example 16 | 16 | B-1 | 30 | A-1 | 95 | A-2 | 5 | a | 2 | b | 2 | $6.84 \times 10^{-4}$ | $1.51 \times 10^{-4}$ | 4.53 |
| Comparative Example 1 | 17 | B-1 | 60 | A-2 | 100 | — | — | b | 4 | c | 2 | $8.92 \times 10^{-1}$ | $7.12 \times 10^{-2}$ | 12.53 |
| Comparative Example 2 | 18 | B-12 | 60 | A-3 | 10 | A-4 | 90 | a | 3 | c | 2 | $8.52 \times 10^{-1}$ | $8.41 \times 10^{-2}$ | 10.13 |
| Comparative Example 3 | 19 | B-13 | 60 | A-1 | 90 | A-2 | 10 | b | 2 | a | 2 | $4.62 \times 10^{-3}$ | $7.52 \times 10^{-3}$ | 0.64 |
| Comparative Example 4 | 20 | B-14 | 75 | A-9 | 100 | — | — | a/b | 3/2 | b | 2 | $6.74 \times 10^{-1}$ | $4.85 \times 10^{-2}$ | 13.90 |

TABLE 5

| | Under high-temperature, high-humidity environment | | | | | |
|---|---|---|---|---|---|---|
| | Image density | | | | | |
| | Initial stage | After printing of 100,000 sheets | Fogging 1.2 kHz | Fogging 2.7 kHz | Fogging 3.6 kHz | Image density unevenness |
| Example 1 | 1.42 | 1.40 | 0.86 | 0.75 | 0.70 | A |
| Example 2 | 1.43 | 1.41 | 0.83 | 0.77 | 0.65 | A |
| Example 3 | 1.43 | 1.41 | 0.80 | 0.68 | 0.62 | A |
| Example 4 | 1.40 | 1.38 | 1.04 | 0.96 | 0.89 | A |
| Example 5 | 1.42 | 1.39 | 0.95 | 0.83 | 0.80 | A |
| Example 6 | 1.40 | 1.33 | 0.81 | 0.79 | 0.74 | B |
| Example 7 | 1.41 | 1.35 | 0.96 | 0.91 | 0.89 | A |
| Example 8 | 1.42 | 1.39 | 1.55 | 1.95 | 2.12 | B |
| Example 9 | 1.41 | 1.39 | 1.61 | 1.52 | 1.75 | A |
| Example 10 | 1.40 | 1.38 | 2.55 | 2.44 | 2.40 | C |
| Example 11 | 1.38 | 1.28 | 0.97 | 0.77 | 0.62 | B |
| Example 12 | 1.39 | 1.26 | 0.72 | 0.84 | 1.05 | C |
| Example 13 | 1.40 | 1.37 | 2.81 | 3.04 | 3.56 | B |
| Example 14 | 1.38 | 1.29 | 2.97 | 3.55 | 3.95 | C |
| Example 15 | 1.42 | 1.39 | 3.82 | 3.70 | 3.64 | C |
| Example 16 | 1.35 | 1.33 | 1.34 | 1.55 | 1.75 | B |
| Comparative Example 1 | 1.28 | 1.26 | 4.82 | 5.32 | 6.12 | A |
| Comparative Example 2 | 1.29 | 1.12 | 4.75 | 5.12 | 6.00 | D |
| Comparative Example 3 | 1.33 | 1.11 | 1.08 | 0.98 | 0.91 | D |
| Comparative Example 4 | 1.29 | 1.10 | 4.45 | 5.00 | 5.89 | D |

TABLE 6

| | Under normal-temperature, normal-humidity environment | | | | | | | |
|---|---|---|---|---|---|---|---|---|
| | Image density | | | | | | | |
| | Initial stage | After printing of 100,000 sheets | Fogging 1.2 kHz | Fogging 2.7 kHz | Fogging 3.6 kHz | Image density unevenness | Color tone a value | Color tone b value |
| Example 1 | 1.45 | 1.44 | 0.56 | 0.45 | 0.41 | A | 0.379 | −0.550 |
| Example 2 | 1.45 | 1.45 | 0.53 | 0.46 | 0.43 | A | 0.302 | −0.605 |
| Example 3 | 1.44 | 1.43 | 0.52 | 0.42 | 0.36 | A | 0.371 | −0.553 |
| Example 4 | 1.44 | 1.43 | 0.75 | 0.65 | 0.58 | A | 0.365 | −0.545 |
| Example 5 | 1.44 | 1.42 | 0.65 | 0.53 | 0.50 | A | 0.368 | −0.558 |
| Example 6 | 1.43 | 1.37 | 0.52 | 0.49 | 0.43 | B | 0.432 | −0.432 |
| Example 7 | 1.42 | 1.35 | 0.66 | 0.62 | 0.59 | A | 0.382 | −0.532 |
| Example 8 | 1.45 | 1.43 | 1.25 | 1.65 | 1.82 | A | 0.384 | −0.514 |
| Example 9 | 1.43 | 1.41 | 1.42 | 1.48 | 1.53 | A | 0.321 | −0.585 |
| Example 10 | 1.43 | 1.41 | 2.25 | 2.12 | 2.11 | C | 0.525 | −0.265 |
| Example 11 | 1.42 | 1.31 | 0.67 | 0.47 | 0.32 | B | 0.452 | −0.382 |
| Example 12 | 1.42 | 1.30 | 0.42 | 0.54 | 0.75 | C | 0.532 | −0.275 |
| Example 13 | 1.44 | 1.41 | 2.52 | 2.75 | 3.25 | A | 0.389 | −0.512 |
| Example 14 | 1.41 | 1.32 | 2.67 | 3.25 | 3.65 | B | 0.465 | −0.332 |
| Example 15 | 1.44 | 1.41 | 3.52 | 3.41 | 3.35 | C | 0.579 | −0.234 |
| Example 16 | 1.38 | 1.36 | 1.05 | 1.25 | 1.45 | A | 0.412 | −0.505 |
| Comparative Example 1 | 1.31 | 1.29 | 4.52 | 5.02 | 5.89 | A | 0.384 | −0.536 |
| Comparative Example 2 | 1.33 | 1.12 | 4.75 | 5.21 | 5.99 | D | 0.835 | −0.023 |
| Comparative Example 3 | 1.36 | 1.15 | 0.78 | 0.68 | 0.63 | D | 0.701 | −0.153 |
| Comparative Example 4 | 1.32 | 1.11 | 4.21 | 4.85 | 5.62 | D | 0.745 | −0.046 |

TABLE 7

| | Under normal-temperature, low-humidity environment | | | | | |
|---|---|---|---|---|---|---|
| | Image density | | | | | |
| | Initial stage | After printing of 100,000 sheets | Fogging 1.2 kHz | Fogging 2.7 kHz | Fogging 3.6 kHz | Image density unevenness |
| Example 1 | 1.48 | 1.47 | 0.41 | 0.31 | 0.25 | A |
| Example 2 | 1.47 | 1.46 | 0.40 | 0.29 | 0.25 | A |
| Example 3 | 1.47 | 1.46 | 0.39 | 0.28 | 0.20 | A |
| Example 4 | 1.46 | 1.45 | 0.61 | 0.50 | 0.43 | A |
| Example 5 | 1.47 | 1.44 | 0.51 | 0.37 | 0.35 | A |
| Example 6 | 1.44 | 1.40 | 0.36 | 0.34 | 0.29 | A |
| Example 7 | 1.44 | 1.38 | 0.51 | 0.47 | 0.44 | A |
| Example 8 | 1.48 | 1.46 | 1.10 | 1.51 | 1.66 | A |
| Example 9 | 1.45 | 1.43 | 1.35 | 1.41 | 1.45 | A |
| Example 10 | 1.47 | 1.42 | 2.10 | 2.00 | 1.96 | B |
| Example 11 | 1.45 | 1.34 | 0.52 | 0.31 | 0.18 | B |
| Example 12 | 1.44 | 1.32 | 0.27 | 0.39 | 0.60 | C |
| Example 13 | 1.47 | 1.44 | 2.36 | 2.61 | 3.11 | A |
| Example 14 | 1.44 | 1.36 | 2.52 | 3.10 | 3.50 | B |
| Example 15 | 1.46 | 1.43 | 3.38 | 3.25 | 3.21 | C |
| Example 16 | 1.41 | 1.39 | 0.90 | 1.10 | 1.30 | A |
| Comparative Example 1 | 1.34 | 1.32 | 4.21 | 5.02 | 5.57 | A |
| Comparative Example 2 | 1.36 | 1.16 | 4.12 | 4.82 | 5.45 | D |
| Comparative Example 3 | 1.39 | 1.14 | 0.78 | 0.68 | 0.62 | D |
| Comparative Example 4 | 1.35 | 1.15 | 4.02 | 4.52 | 5.22 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-015976, filed Jan. 26, 2007, which is hereby incorporated by reference herein in its entirety.

What is claimed is:

1. A magnetic toner comprising magnetic toner particles each comprising a binder resin and a magnetic iron oxide particle, wherein:

when a solution is prepared by dissolving the magnetic iron oxide particles in an acidic aqueous solution and an Fe element amount in a solution in which all the magnetic iron oxide particles are dissolved is defined as a total Fe element amount, a ratio X of an amount of Fe(2+) in a solution in which the magnetic iron oxide particles are dissolved to a state where 10 mass % of the total Fe element amount is present in the solution (solution having an Fe element-dissolving ratio of 10 mass %) to an Fe element amount in the solution having an Fe element-dissolving ratio of 10 mass % is 34 mass % or more and 50 mass % or less; and dielectric loss tangents of the magnetic toner measured at a temperature of 40° C. satisfy the following conditions (a) to (c):

(a) a dielectric loss tangent A at a frequency of 10,000 Hz is $1.0\times10^{-6}$ or more and $1.0\times10^{-1}$ or less;

(b) a dielectric loss tangent B at a frequency of 1,000 Hz is $1.0\times10^{-6}$ or more and $1.0\times10^{-1}$ or less; and (c) a ratio (A/B) of the dielectric loss tangent A to the dielectric loss tangent B is 0.10 or more and 10.00 or less.

2. A magnetic toner according to claim 1, wherein the dielectric loss tangent B is $1.0\times10^{-5}$ or more and $1.0\times10^{-2}$ or less.

3. A magnetic toner according to claim 1, wherein the dielectric loss tangent A is $1.0\times10^{-5}$ or more and $1.0\times10^{-2}$ or less.

4. A magnetic toner according to claim 1, wherein, when a value (C/D) obtained by dividing a value C obtained by subtracting the amount of Fe(2+) in the solution having an Fe element-dissolving ratio of 10 mass % from an amount of Fe(2+) in the solution in which all the magnetic iron oxide particles are dissolved by a value D obtained by subtracting the Fe element amount in the solution having an Fe element-dissolving ratio of 10 mass % from the total Fe element amount is represented by Y, the magnetic iron oxide particles have a ratio (X/Y) of X to Y of more than 1.00 and 1.30 or less.

5. A magnetic toner according to claim 1, wherein the magnetic iron oxide particles each have an octahedral shape.

6. A magnetic toner according to claim 1, wherein the magnetic iron oxide particles have a number average primary particle diameter of 0.10 μm or more and 0.30 μm or less.

7. A magnetic toner according to claim 1, wherein the magnetic iron oxide particles have a magnetization in an external magnetic field of 795.8 kA/m of 86.0 $Am^2/kg$ or more.

* * * * *